US006331052B1

(12) United States Patent
Murai et al.

(10) Patent No.: US 6,331,052 B1
(45) Date of Patent: Dec. 18, 2001

(54) INK JET PRINTING APPARATUS

(75) Inventors: Taeko Murai; Shuzo Matsumoto; Mitsumi Fujii, all of Yokohama; Tomoaki Nakano, Kawasaki; Hideyuki Makita, Yokohama; Yoshihisa Ohta, Hachioji; Shinichi Kakuda, Yokohama; Tetsuro Hirota, Hadano, all of (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 09/158,660

(22) Filed: Sep. 22, 1998

(30) Foreign Application Priority Data

Sep. 22, 1997 (JP) ..... 9-256278
Sep. 25, 1997 (JP) ..... 9-260075
Jul. 13, 1998 (JP) ..... 10-196913

(51) Int. Cl.[7] ..... B41J 29/38; B41J 2/16; B41J 2/045

(52) U.S. Cl. ..... 347/68; 347/10; 347/48

(58) Field of Search ..... 347/68, 11, 10, 347/17, 20, 40, 94, 69–72, 12, 13, 44, 48

(56) References Cited

U.S. PATENT DOCUMENTS 5,204,695 * 4/1993 Tokunaga et al. ..... 347/11
5,499,042 * 3/1996 Yanagawa ..... 347/69
5,831,650 * 11/1998 Reinten ..... 347/68
5,923,351 * 7/1999 Hosono et al. ..... 347/68
6,053,596 * 4/2000 Nakano et al. ..... 347/15

* cited by examiner

*Primary Examiner*—John Barlow
*Assistant Examiner*—An H. Do
(74) *Attorney, Agent, or Firm*—Greenberg Traurig, LLP

(57) ABSTRACT

An ink jet printing apparatus includes an ink jet head having a plurality of nozzles for respectively ejecting ink drops, a plurality of ink chambers communicating with the nozzles, and a plurality of electromechanical conversion elements corresponding to the respective nozzles. The volume of the ink chamber of the non-drive channel is increased by the influence of the drive channel adjacent thereto, and thereby undesired ejection of the ink drop occurs. To solve this problem, a drive energy set for ejecting the ink drop is applied to the piezoelectric elements of the drive chambers n−1, n+1 and a reduced drive energy set for not ejecting the ink drops is applied to the piezoelectric element of the non-drive channel n.

51 Claims, 29 Drawing Sheets

PZTn−1 (DRIVE)
EXPANDING

PZTn (NON−DRIVE)

PZTn+1 (DRIVE)
EXPANDING
PUSHING UP
y1

NOZZLE PLATE n−1
PUSHING UP
y2

NOZZLE PLATE n
PUSHING UP
y1

NOZZLE PLATE n+1
td
td

INK CHAMBER VOLUME n−1
DECREASING
INCREASING

INK CHAMBER VOLUME n

INK CHAMBER VOLUME n+1
DECREASING

EXPANDING

PZTn−1 (DRIVE)

PZTn (PRELIMINARY DRIVE)
EXPANDING

PZTn+1 (DRIVE)

PUSHING UP
y1
NOZZLE PLATE n−1
y2
PUSHING UP

NOZZLE PLATE n
PUSHING UP
y1

NOZZLE PLATE n+1
td
td

INK CHAMBER VOLUME n−1
DECREASING

INK CHAMBER VOLUME n
DECREASING

INK CHAMBER VOLUME n+1
DECREASING

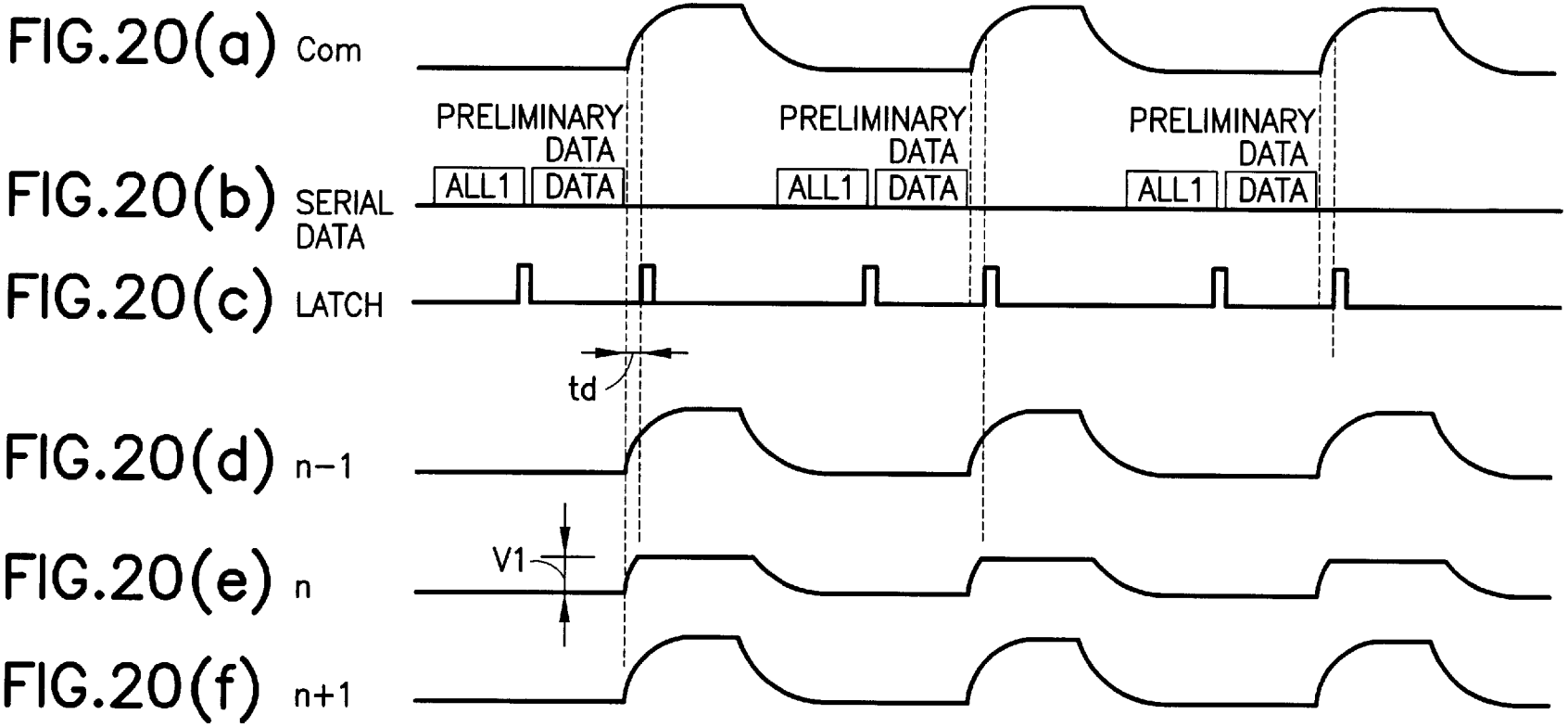
FIG.20(a) Com
FIG.20(b) SERIAL DATA
FIG.20(c) LATCH
FIG.20(d) n−1
FIG.20(e) n
FIG.20(f) n+1
PRELIMINARY DATA
ALL1
DATA
td
V1

| n−1 | NOZZLE TO BE NOTED n | n+1 |
|---|---|---|
| DRIVE | PRELIMINARY DRIVE; EXISTING | DRIVE |
| DRIVE | PRELIMINARY DRIVE; NOT EXISTING | NON−DRIVE |

FIG.21

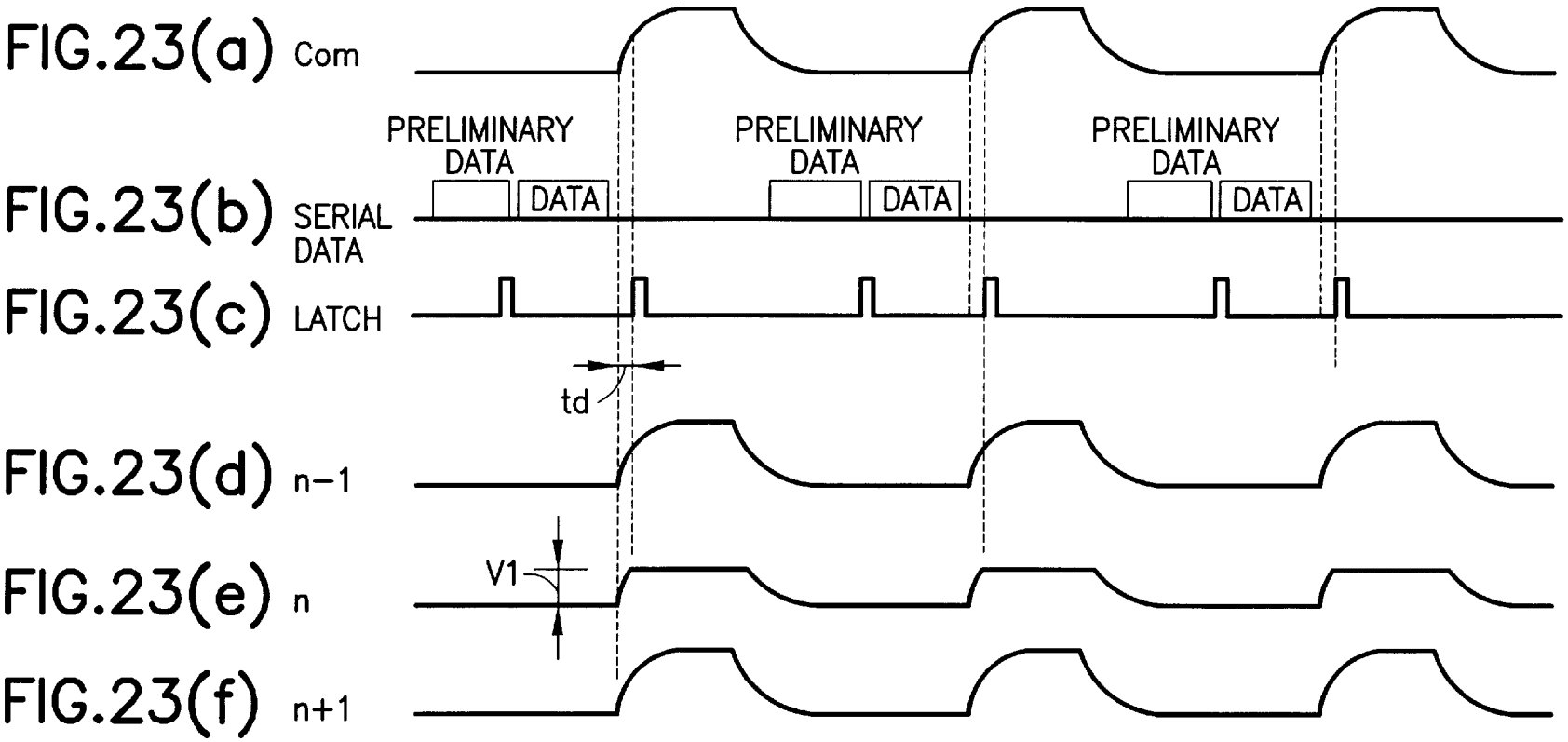
FIG.23(a) Com
FIG.23(b) SERIAL DATA
FIG.23(c) LATCH
FIG.23(d) n−1
FIG.23(e) n
FIG.23(f) n+1
PRELIMINARY DATA
DATA
td
V1

FIG.26(a) Com
FIG.26(b) SERIAL DATA
FIG.26(c) LATCH
FIG.26(d) n−2
FIG.26(e) n−1
FIG.26(f) n
FIG.26(g) n+1
FIG.26(h) n+2
NON−EJECTION DRIVE DATA
DATA
td
V1

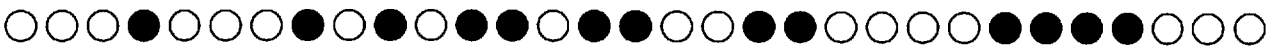
FIG.28(a)
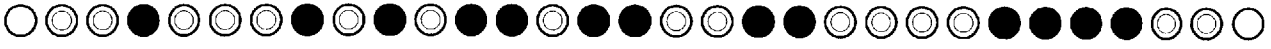
FIG.28(b)
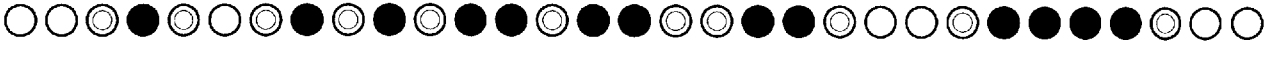
FIG.28(c)
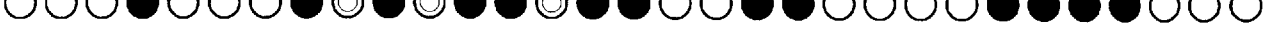
FIG.28(d)
FIG.28(e)

INK JET PRINTING APPARATUS

BACKGROUND OF THE INVENTION

1. Field of the Invention

The present invention relates to an ink jet printing apparatus, and more particularly, to an ink jet printing apparatus provided with an ink jet head including a plurality of nozzles.

2. Discussion of the Related Art

In the ink jet printing apparatus provided in a printer, a facsimile device, a copying machine, etc., an ink drop is ejected from a selected nozzle by driving the energy generating medium of the ink jet head in accordance with the printing data by use of an ink jet head provided with a plurality of nozzles for ejecting ink drops, an ink chamber communicating with the respective nozzles, and energy generating media (energy generating elements) such as electromechanical conversion elements or electrothermal conversion elements for generating energy in order to pressurize ink in the respective ink chambers and thereby eject ink drops from the nozzles.

In the present specification, "to drive the energy generating medium" is also referred to as "to drive the nozzle" or "to drive the channel".

When ejecting an ink drop from a selected or designated nozzle, the meniscus of an adjacent non-ejection nozzle which is at that time prohibited from ejecting an ink drop (called "non-drive nozzle") is put in an unstable state by the mechanical or fluid interference.

As a result, the ink ejection speed Vj and the ink ejection amount Mj vary. In the end, air enters the ink chamber through the nozzle of the non-ejection nozzle. Furthermore, in the case of a "non-drive nozzle" being surrounded by two nozzles on either side of the "non-drive nozzle" which are "ejection nozzles" or "drive nozzles" for ejecting an ink drop, the energy generating medium of the two drive nozzles pressurizes the ink chamber and thereby the nozzle forming member of the non-drive nozzle is slightly pushed up. For this reason, the inner volume of the ink chamber of the non-drive nozzle is slightly increased, and thereby, the ink meniscus of the non-drive nozzle is pulled toward the inside of the non-drive nozzle. If such a phenomenon occurs successively, air is accumulated in the ink chamber of the non-drive nozzle.

When the air is accumulated in the ink chamber of the non-drive nozzle in such a way, even though the ink chamber of the non-drive nozzle is pressurized by the energy generating medium, after the non-drive nozzle has been changed to a drive nozzle, the ink drop may not be ejected. As a result, the image quality is lowered and the printing results deteriorate.

In the prior art, there are many methods of driving ink jet print heads. For instance, as described in the published specification of Japanese Laid-open Patent Publication No. 58-203/1983, an ink jet printing head includes adjacent ink chambers and nozzles. In order to make an ink ejection speed uniform in all cases, when one of the pressure chambers is pressurized to thereby eject an ink drop therefrom, the other adjacent pressure chamber is pressurized to a level such that an ink drop is not ejected.

In another prior art device described in the published specification of Japanese Laid-open Patent Publication No. 6-8428/1994, an ink jet printing apparatus includes a pulse signal outputting medium for outputting signals having different pulse widths in synchronism with the drive signal and a signal selection medium for selecting one signal from the output signals. The ON-OFF state of the piezoelectric element driving medium is changed even in the unsaturated area of the drive signal. As a result, the voltage applied to the piezoelectric element is changed so as to make constant the amount of the ink in each ink drop ejected from the respective nozzles. Such a method of driving is well known.

Furthermore, in the ink jet printing apparatus in which plural signals respectively having different pulse widths in synchronism with the drive signal are output and the applied voltage is changed by selecting one signal from the plural signals and changing the state of the drive media for charging the respective piezoelectric elements from "on" to "off", if the turn-off time of the transistors becomes uneven, the applied voltage also becomes uneven. As a result, the applied voltage cannot be controlled with high precision.

SUMMARY OF THE INVENTION

To overcome the above-mentioned problems in the prior art, the preferred embodiments of the present invention provide an ink jet printing apparatus capable of reliably and accurately ejecting an ink drop to thereby produce an image of exceptionally high quality.

According to a preferred embodiment of the present invention, an ink jet printing apparatus includes an ink jet head, having a plurality of nozzles for respectively ejecting ink drops, a plurality of ink chambers communicating with the plurality of nozzles, and a plurality of electromechanical conversion elements corresponding to the respective nozzles, wherein a volume inside of the ink chamber is changed by driving the electromechanical conversion elements in order to eject the ink drops from the respective nozzles and a non-ejection driving waveform having drive energy to an extent of not ejecting the ink drops is applied to all of the electromechanical conversion elements of the non-drive nozzles not ejecting any ink drops when the electromechanical conversion elements of the ink jet head are driven in accordance with the image data.

By applying the non-drive energy or waveform to the non-drive electromechanical conversion elements corresponding to the non-drive nozzles, an increase in the ink chambers of the non-drive nozzles is cancelled and problems with mis-ejection or insufficient ejection of ink drops are prevented and accurate and high quality images are produced.

According to another preferred embodiment of the present invention, the ink jet printing apparatus described above includes a medium for transmitting data for driving the electromechanical conversion elements of the non-drive nozzles such that drive energy set for not ejecting the ink drive is applied by restricting a drive voltage of the drive waveform which is applied to the electromechanical conversion elements of drive elements for ejecting an ink drop. As a result, the reduced drive energy restricted as described above to a level such that ink drops are not ejected is applied to the electromechanical conversion elements of the non-drive nozzles by a significantly simplified structure.

According to another preferred embodiment of the present invention, the ink jet printing apparatus described above is constructed such that when the electromechanical conversion element is driven in accordance with the image data, the drive energy set for not ejecting an ink drop is applied to the electromechanical conversion element of a specified non-drive nozzle. As a result, a volume increase in the ink chamber of the non-drive nozzle is cancelled and consequently, an undesirable ink jet mis-ejection or insufficient ejection due to sucking of air is prevented. This ink jet printing apparatus, therefore, accurately and reliably produces excellent image quality and significantly reduces power consumption and ink dot migration.

Other features, advantages and beneficial characteristics of the present invention will become more apparent from the detailed description of preferred embodiments thereof which will be described below with reference to the attached drawings.

BRIEF DESCRIPTION OF THE DRAWINGS

A more complete appreciation of the invention and many of the advantages achieved will be better understood by reference to the following detailed description of preferred embodiments of the present invention when considered in connection with the accompanying drawings, wherein:

FIGS. 20(*a*) through 20(*f*) are explanatory diagrams for explaining the operation of an example of the channel selecting circuit in the case of applying the drive waveform for not ejecting the ink drop to the non-drive channel;

FIG. 21 is an explanatory diagram for explaining the preliminary drive pattern of the non-drive channel;

FIGS. 23(*a*) through 23(*f*) are explanatory diagrams for explaining the function of the circuit shown in FIG. 22;

FIGS. 28(*a*) through 28(*e*) are explanatory diagrams for explaining the non-ejection driving pattern of the non-drive nozzle.

DETAILED DESCRIPTION OF PREFERRED EMBODIMENTS

Figure 1:
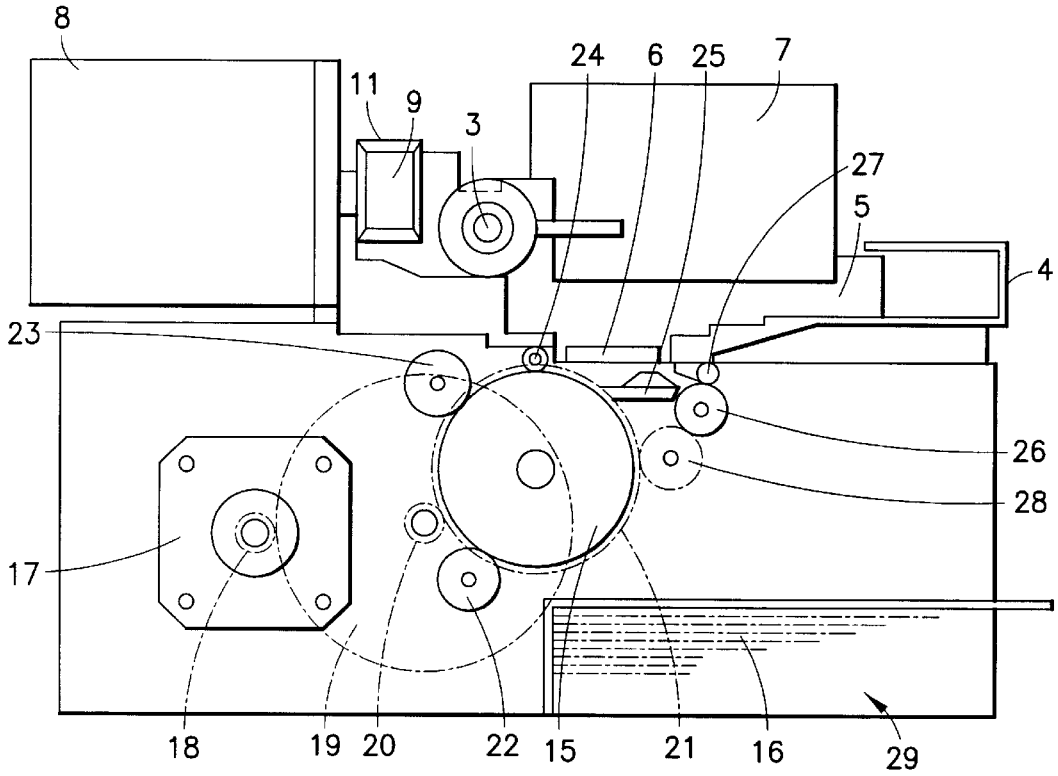
FIG. 1 is a side view showing a mechanism of an ink jet printing apparatus according to a preferred embodiment of the present invention.
Figure 2:
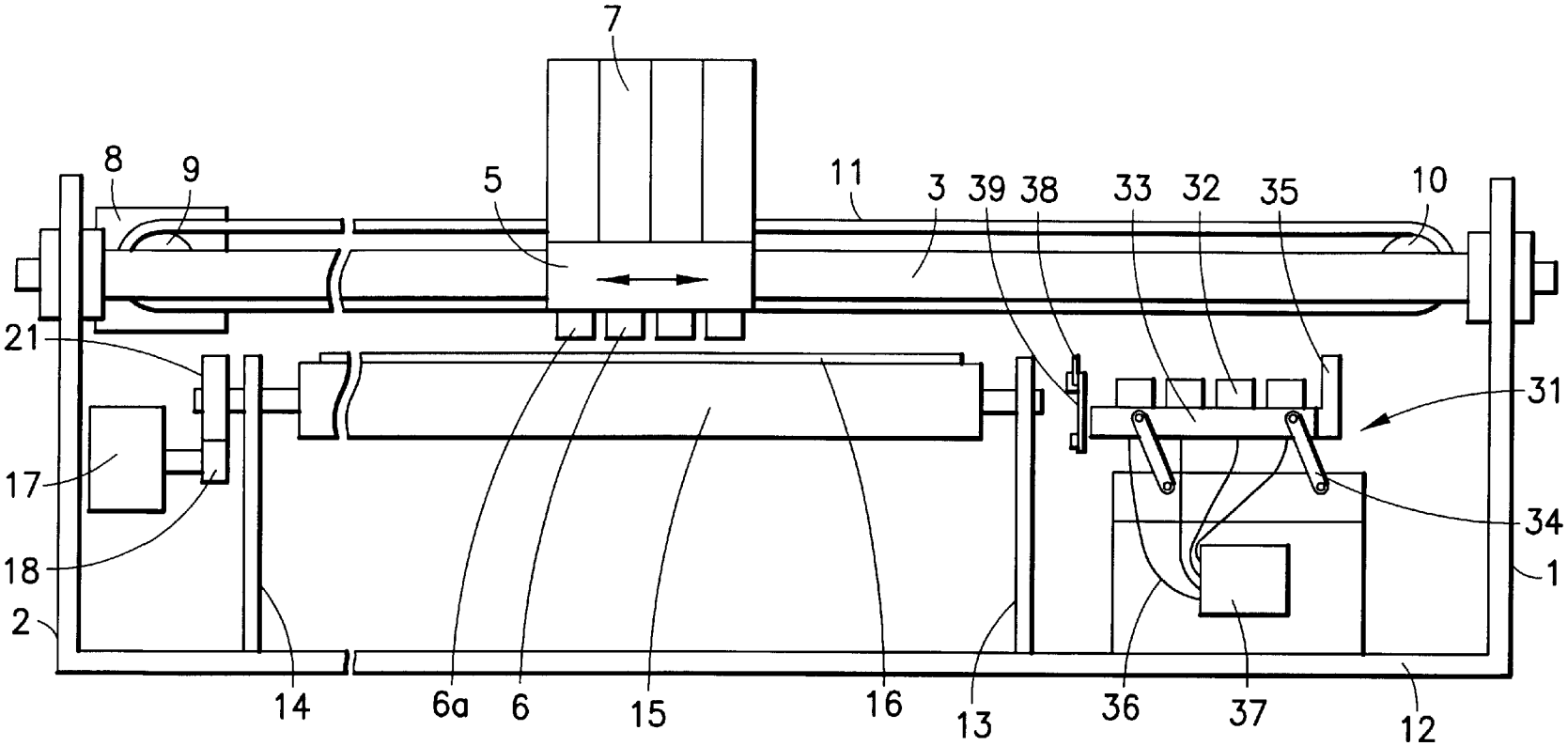
FIG. 2 is a front view showing the ink jet printing apparatus of FIG. 1.
Figure 3:
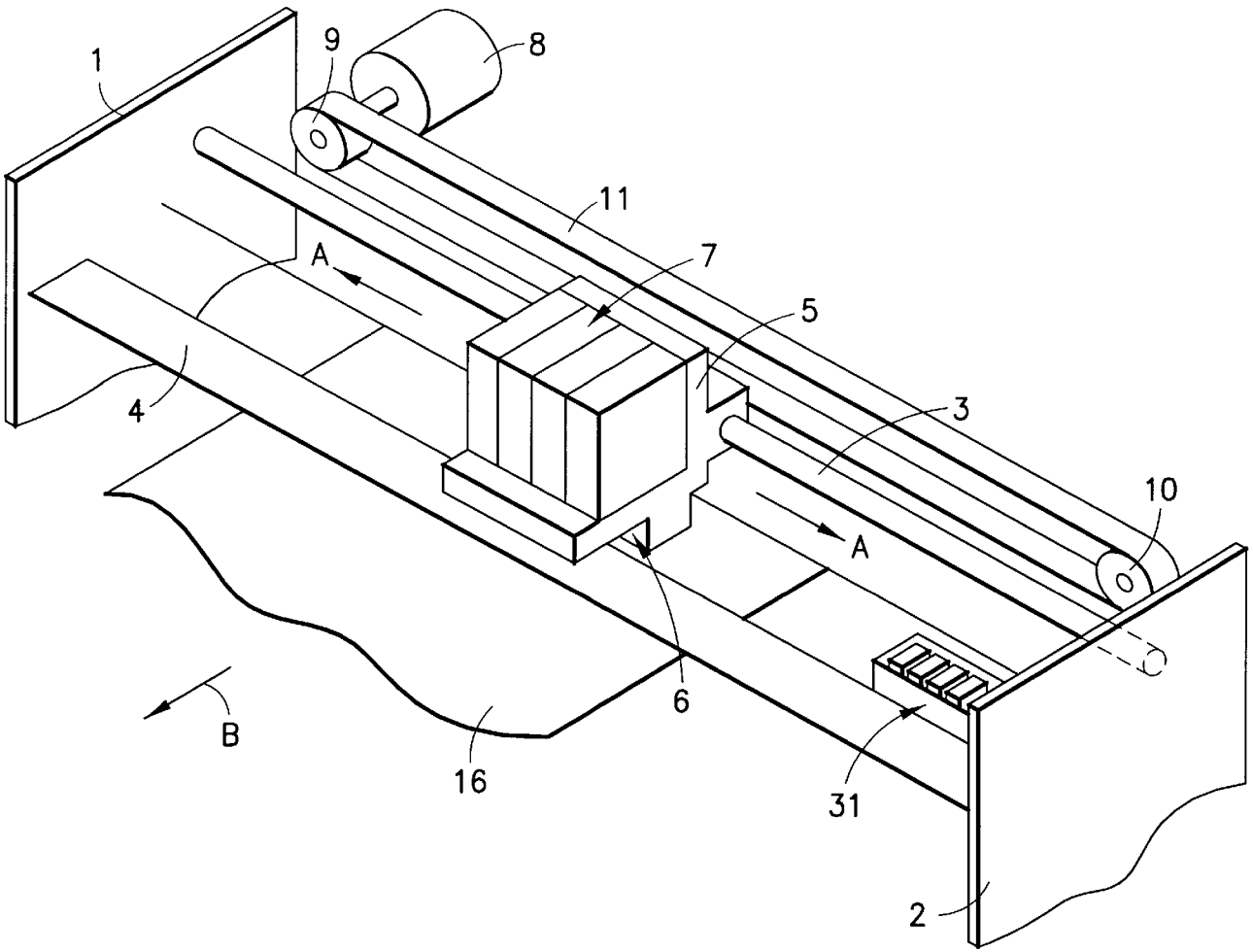
FIG. 3 is a perspective view showing the ink jet printing apparatus of FIG. 1.

Preferred embodiments of the present invention are described hereinafter, referring to the accompanying drawings. FIG. 1 is a side view showing a mechanism portion of the ink jet printing apparatus according to a preferred embodiment of the present invention. FIG. 2 is a front view and FIG. 3 is a perspective view of the ink jet printing apparatus of FIG. 1.

In the mechanism portion of the ink jet printing apparatus, a guide rod 3 and a guide plate 4 are transversely supported between side plates 1 and 2 disposed at the both sides thereof. One end portion of a carriage 5 is securely held so as to freely slide on the guide rod 3, and the other end portion of the carriages is disposed on the guide plate 4 so as to slide thereon. The carriage 5 can be moved in the main scannings direction which is the direction shown by the arrow in FIGS. 2 and 3.

A printing head 6 preferably including four ink jet heads for respectively ejecting Yellow(Y) ink, Magenta(M) ink, Cyan(C) c ink, and Black(Bk) ink therefrom is carried on the lower surface side of the carriage 5 so that an ejecting surface (nozzle surface) 6*a* of the printing head is pointed in a downward direction. Four ink cartridges 7 used as respective color ink supplying bodies for respectively supplying ink of the respective colors to the printing head 6 are interchangeably mounted and carried on the upper surface of the carriage 5.

The carriage 5 is engaged with a timing belt 11 suspended between a drive pulley 9 rotated by a main scanning motor 8 and a driven roller 10 and cooperates therewith. By controlling the drive of the main scanning motor 8, the carriage 5, that is, the printing head 6 including the four color ink jet heads is moved in the main scanning direction (in the direction of the arrow in FIG. 2).

Furthermore, subframes 13 and 14 are mounted on a bottom plate 12 for connecting the side plates 1 and 2 to each other, and a platen roller (conveying roller, hereinafter, called "platen") 15 for conveying paper 16 in the subscanning direction, which is perpendicular to the main scanning direction, is rotatably held between the subframes 13 and 14. Furthermore, a subscanning motor 17 preferably comprising a stepping motor is mounted on the side of the subframe 14. In order to transmit the rotation of the subscanning motor 17 to the platen 15, there are further provided a gear 18 fixed on the rotation shaft of the subscanning motor 17, intermediate rollers 19 and 20, and a platen gear 21 fixed on the shaft of the platen 15.

Furthermore, paper feeding rollers 22 and 23 pressed onto the circumferential surface of the platen 15 and a pinch roller 24 for defining an angle of conveying the recording paper 16, a guide plate 25 opposed to the printing head 6, a paper discharging roller 26 situated at the lower side in the paper conveying direction from the printing head 6 and a spur roller 27 for pressing the paper 16 which is brought into direct pressing contact with the paper feeding roller 26 are provided in the mechanism portion of the ink jet printing apparatus. The paper discharging roller 26 is rotatively driven through the gear 28 engaging with the platen gear 21.

The rotation of the subscanning motor 17 is transmitted to the platen roller 15 through the gear 18 and rollers 19 and 20 and platen gear 21. The recording paper 16 accommodated in a paper feeding portion 29 is emitted out to the space between the printing head 6 and the guide plate 25 so that the platen roller 15 moves the paper 16 in the subscanning direction. The paper discharging roller 26 and the paper pressing spur roller 27 emits the recording paper 16 in the paper discharging direction (the direction shown by the arrow marked B in FIG. 3).

Furthermore, there is disposed a mechanism for maintaining and recovering the reliability of the printing head 6, which mechanism is hereinafter referred to as a "subsystem" 31.

In the subsystem 31, four capping media 32 for capping the ejection surface 6a of the respective printing heads 6 are supported by a holder 33. The holder 33 is held by a linking member 34 so that the holder 33 moves in a rocking manner. The carriage 5 is brought into direct contact with an engaging portion 35 provided on the holder 33 by the action of the movement of the carriage 5 in the main scanning direction thereof. Thereby, in accordance with the movement of the carriage 5, the holder 33 is lifted up and the ejection surface 6*a* of the printing head 6 is capped with the capping medium 32, and then the holder 33 is moved down in accordance with the movement of the carriage 5 by moving the carriage 5 to the side of the printing area. As a result of this movement, the capping medium 32 is removed from the ejection surface 6*a* of the printing head 6.

The respective capping media 32 are connected to a sucking pump 37 through sucking tubes 36, and the capping media 32 respectively form opening portions therein so as to communicate with the outer air through the opening tubes and opening valves. Furthermore, the sucking pump 37 discharges the sucked waste liquid ink into the waste ink receiving tank (not shown) through a drain tube.

Furthermore, at the side of the holder 33, a wiper blade 38 is mounted on a blade arm 39 of the wiper blade 38 which is a wiping medium preferably including an elastic member made of fiber, polyurethane foam or other foam material, rubber, or the like. The blade arm 39 is pivotally supported so as to move in the rocking manner. The arm 39 can be pivotally moved by the action of the rotation of a cam (not shown) driven by a driving medium (not shown).

In a recording apparatus constructed in such a way as described above, the printing head 6 (carriage 5) is moved in the main scanning direction, while the recording paper 16 is transported in the subscanning direction. Ink drops of a desired color are ejected from the nozzles of the respective printing heads 6, and thereby, the color image of a desired color (including a black color image) can be recorded on the recording paper 16.

Figure 4:
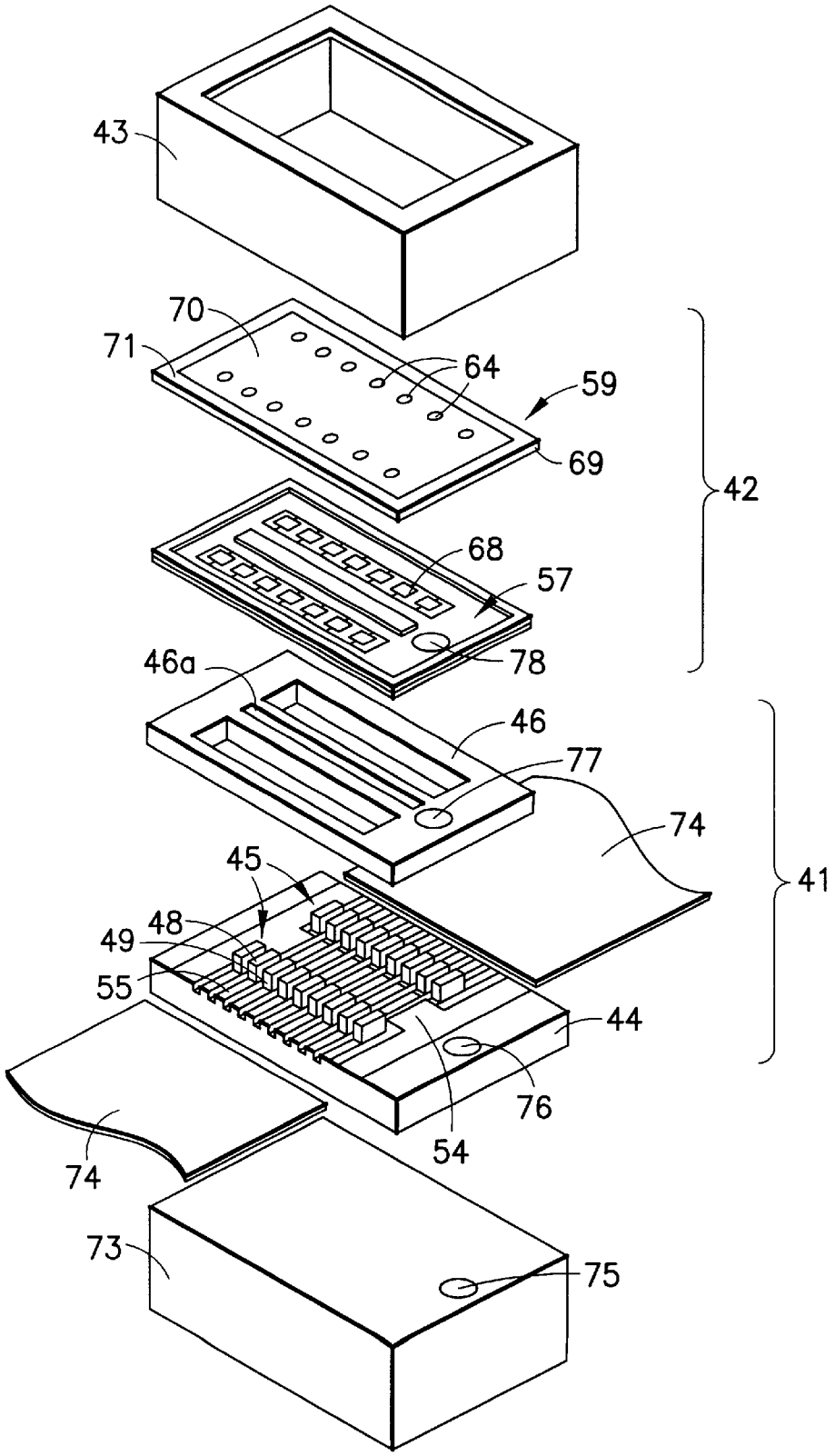
FIG. 4 is an exploded perspective explanatory view for illustrating the ink jet head of the ink jet printing apparatus of FIG. 1.
Figure 5:
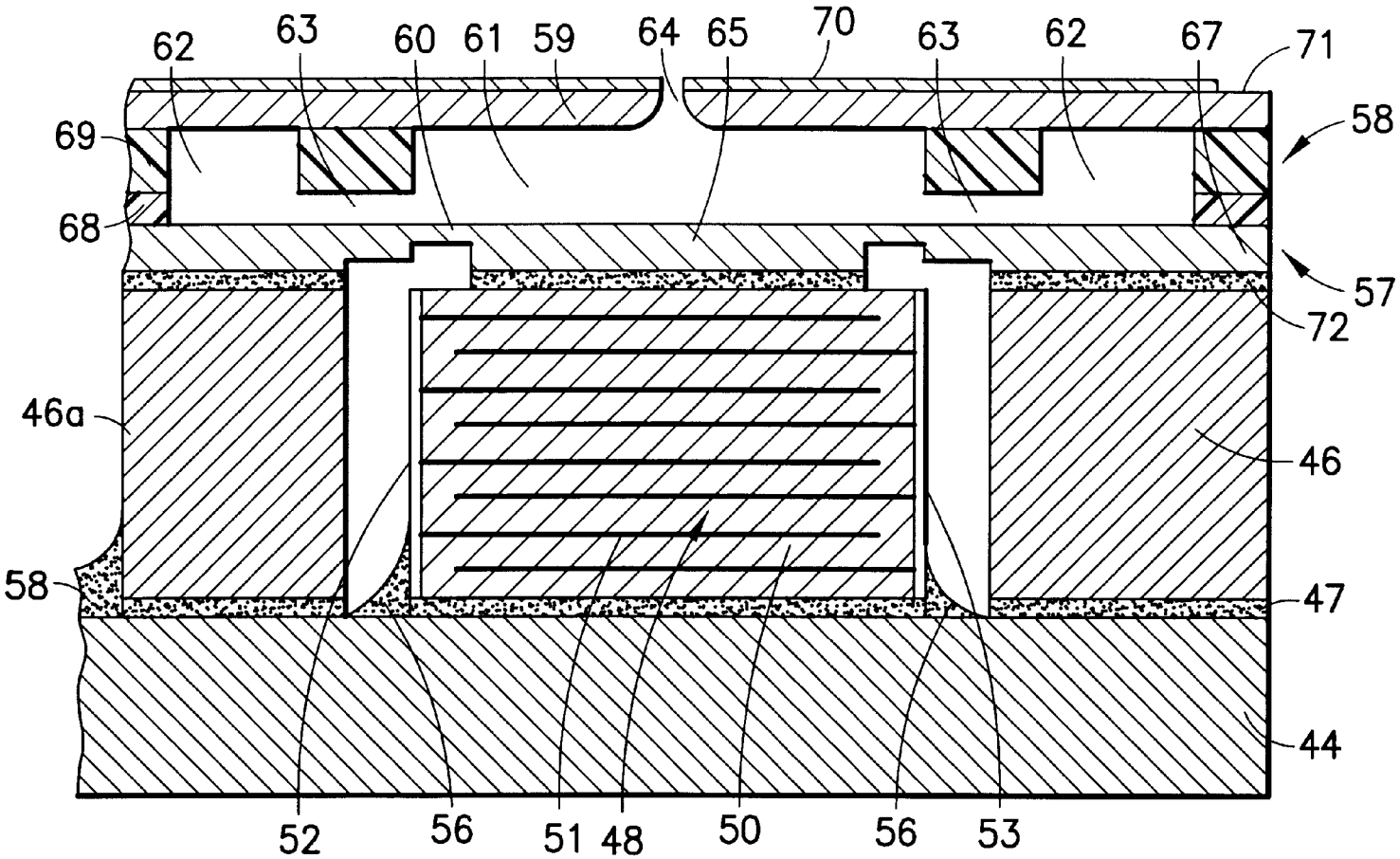
FIG. 5 is a cross-sectional view showing the main part in a direction perpendicular to the channel direction of the ink jet head of FIG. 1.
Figure 6:
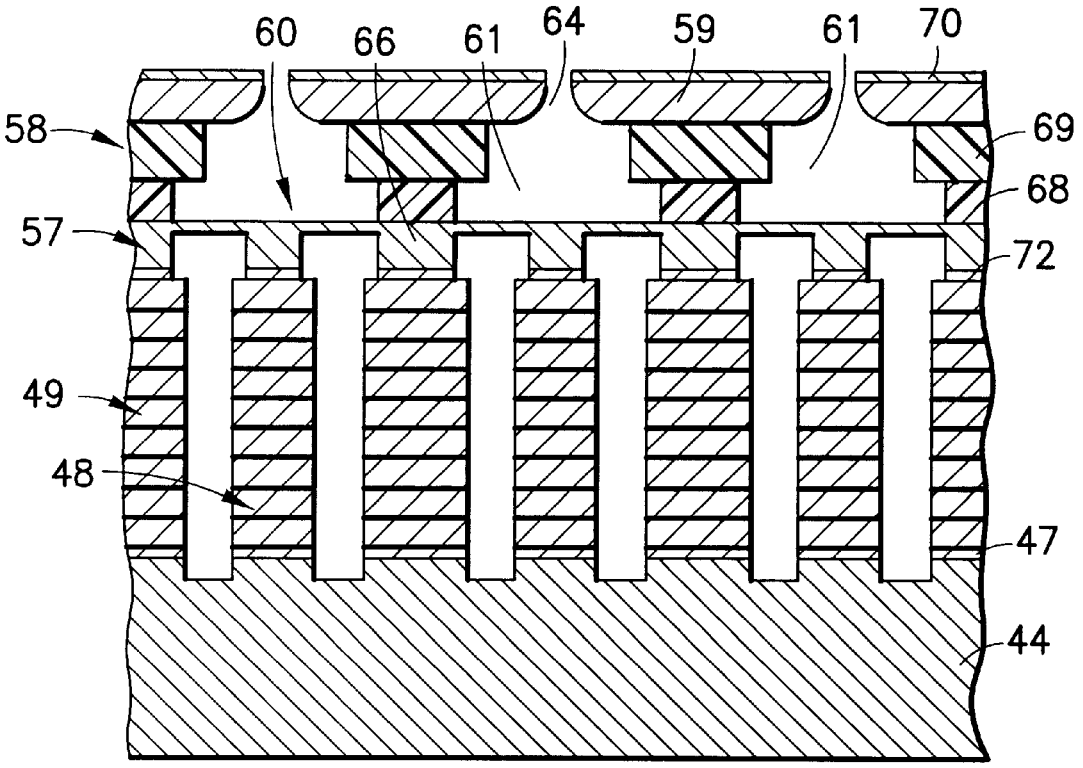
FIG. 6 is a cross-sectional view showing the main part in the channel direction of the ink jet head of FIG. 1.

Next, an example of the ink jet head constituting the printing head is described hereinafter, referring to FIGS. 4 through 6. In the description thereof, FIG. 4 is an exploded perspective explanatory view for illustrating the ink jet head provided in the ink jet printing apparatus, FIG. 5 is an enlarged cross-sectional view showing the main part in a direction perpendicular to the channel direction (nozzle arranging direction) of the same ink jet head, and FIG. 6 is an enlarged cross-sectional view showing the main part in the channel direction of the same ink jet head.

The ink jet head includes a drive unit 41, a ink chamber unit 42, and a head cover 43.

In the drive unit 41, plural lamination type piezoelectric elements 45 functioning as the energy generating medium are arranged in plural rows on an insulation base plate 44 preferably made of a material such as a ceramic substrate, for instance, barium titanate, alumina, forsterite, and the piezoelectric elements 45 thus arranged are joined to the insulation base plate 44.

A frame member (supporting body) 46 made of resin, ceramics, etc. and surrounding the periphery of the rows of piezoelectric elements 45 is bonded to the circumference of the piezoelectric elements via the adhesive agents.

The piezoelectric elements 45 include a first group of piezoelectric elements and a second group of piezoelectric elements. The first group of piezoelectric elements 45 is called a "drive section" 48. A drive pulse is applied to the drive section 48 in order to form an ink drop and eject the formed ink drop through the nozzle to outside of the ink jet head. The second group of piezoelectric elements is called a "non-drive section" 49. No drive pulse is applied to the non-drive section 49. The respective piezoelectric elements 45 of the non-drive section 49 are respectively situated on the areas between the piezoelectric elements of the drive section 48 and respectively serve only as the ink chamber supporting pole member for fixing the ink chamber unit 42 to the base plate 44.

Lamination type piezoelectric elements having more than ten layers are preferably used as the piezoelectric elements 45. In the lamination type piezoelectric elements, as shown in FIG. 5, internal electrodes 51 are alternately laminated. The internal electrodes 51 are respectively composed of zirconium zinc titanate (PZT) layers 50 preferably having a thickness of about 10~50 $\mu$m/layer and silver-palladium (AgPd) having a thickness of several $\mu$m/layer. However, the materials used to form the piezoelectric elements 45 are not limited to the above-mentioned materials. Other types of electromechanical conversion elements can be used instead of the piezoelectric elements shown in FIG. 5.

The internal electrodes 51 of the respective piezoelectric elements 45 are connected to the right and left edge surface electrodes 52 and 53 made of AsPd for every other layer. As to the electrodes 52 and 53, the electrode at the side of the surface opposed to the two rows of the piezoelectric element 45 is the edge surface electrode 52, while the electrode at the side of the surface not opposed thereto is the edge surface electrode 53. As shown in FIG. 4, there are provided respective patterns for the common electrode 54 and the selection electrode 55, both formed on the base plate 44, via Ni-Au vacuum evaporation, Au plating AgPt paste printing, AgPd paste printing or other suitable methods.

Furthermore, the edge surface electrodes 52 opposed to the respective piezoelectric elements 54 of the respective rows are respectively connected to the common electrode 54 via electrically conductive adhesive agents 56 seen in FIG. 5. On the other hand, the other edge surface electrodes 53 not opposed to the respective piezoelectric elements 45 of the respective rows are respectively connected to the respective selection electrodes 55 via electrically conductive adhesive agents 56 in the same way.

In such a structure as described above, by applying the drive voltage to the drive section 48, an electric field occurs in the lamination direction of the layers 50, and thereby a displacement due to expansion in the lamination direction is caused in the drive section 48. Moreover, as shown in FIG. 4, a hole 46*a* formed in the frame member 46 is filled with the electrically conductive adhesive agents 56, and thereby the common electrode 54 is electrically connected to the pattern connected to the respective piezoelectric element 45.

The ink chamber unit 42 is formed by laminating, in order, a vibration plate 57 having a lamination structure composed of a laminated body of metal thin film layers, an ink chamber partition member 58 having a two-layer structure made of a photosensitive resin layer composed of a dry-film-resistor (DFR), and a nozzle plate 59 made of metal, resin, etc., which elements are thermally fused.

One channel can be assembled by combining one piezoelectric element 45 of the drive section 48, a diaphragm section Go corresponding to the piezoelectric element 45, a pressurized ink chamber 61 which is pressurized through the diaphragm section 60, common ink chambers 62, 62 which are respectively positioned at both sides of the pressurized ink chamber 61 and guide the ink to be supplied to the chamber 61, ink supplying paths 63, 64 jointly used as the fluid resistance portion for causing the pressurized ink chamber 61 to communicate with the common ink chambers 62, 62, and a nozzle 64 communicating with the pressurized ink chamber 61. A plurality of channels or nozzles 64 are preferably arranged in two rows.

The vibration plate 57 is preferably made of a nickel-plated film having a two-layer structure. The diaphragm section 60 corresponding to the drive section 48, an island-shaped convex portion 65 unitarily formed at the approximate center portion of the diaphragm section 60 in order to connect it to the drive section 48, a circumferential portion 67 to be joined to the bridge structure portion 66 bonded to the non-drive section 49 and the frame member 46 are respectively disposed therein.

The ink chamber partition member 58 is formed by thermally and pressurizedly bonding a first photosensitive resin layer 68 and a second photosensitive resin layer 69 to each other. In the first photosensitive resin layer 68, the dry film resistor is previously applied to the surface at the side of the vibration plate 57, the dry film resistor thus applied thereto is preferably exposed to the light by use of the desired mask and developed thereafter in order to form a predetermined ink chamber pattern. In the second photosensitive resin layer 69, the dry film resistor is previously applied to the surface at the side of the nozzle plate 59 such that the dry film resistor thus applied thereto is exposed to the light by use of the desired mask and developed thereafter in order to form a predetermined ink chamber pattern.

A large number of nozzles 64 functioning as fine ink ejecting openings for ejecting the ink drops through the nozzle 64 are formed on the nozzle plate 59. Those nozzles 64 preferably have a shape that is a substantially circular cylinder, a substantially circular cone frustum, or horn, etc., at the inner portion thereof. The diameter of the nozzle 64 is preferably about 25~35 $\mu$m at the outlet side thereof for ejecting the ink drop. The ink-ejecting surface (nozzle front surface side) of the nozzle plate 59 is preferably a surface having a water-repellent surface 70 treated with the water-repellent finish, as shown in FIG. 5. For instance, a layer formed by the water-repellent finish selected in accordance with the ink property such as film substrates formed by the PTFE-Ni eutectoid-plating, or the electrodeposition coating of a fluorine-containing resin, or the vacuum evaporation coating with the volatile fluorine-containing resins (for example, fluorinated pitch and the like) the baking treatment after applying the solution of silicone resins or fluorine-containing resins is provided on the ink ejecting surface.

In such a structure, the shape of the ink drop and the ink ejecting property is stabilized and made reliably uniform, and thereby a high quality image can be produced. Furthermore, the circumferential portion 71 of the nozzle plate 59 is preferably a surface which does not include a water-repellent finish, and has no water-repellent layer formed thereon.

After the drive units 41 and the ink chamber units 42 are mechanically processed and assembled respectively individually, the vibration plate 57 of the ink chamber unit 42, the piezoelectric element 45 of the drive unit 41, and the frame member 46 are bonded to each other preferably via the adhesive agents 72.

Then, the base plate 44 is supported and held on the spacer member 73 which functions as the head supporting member. The PCB base plate containing therein the head driving ICs. disposed in the spacer member 73 and the respective electrodes 54 and 55 connected to the respective piezoelectric elements 45 of the drive unit 41 are connected to each other through FPC cables 74, 74.

Furthermore, the nozzle cover 43 is preferably formed in the shape of a box for covering the circumferential part of the nozzle plate 59 and the side surface of the print head. An open portion in the cover 43 is formed corresponding to a location of the surface with water-repellent finishing 70 of the nozzle plate 59, and the nozzle cover 43 is bonded via the adhesive agents to the surface 71 which does not have the water-repellent finish on at the circumferential portion of the nozzle plate 59. Furthermore, the ink jet head is provided with a spacer member 73, a base plate 44, a frame member 46 and a vibrating plate 57 respectively having ink supplying holes 75 through 78, in order to supply the ink to the ink chamber from the ink cartridge which is not shown in the drawings.

In such an ink jet head, the drive waveform (pulse voltage of about 10~50 v) is applied to the drive section 48 in accordance with a recording signal applied thereto. Thereby, a displacement occurs in the drive section 48 in the laminating direction thereof, and the pressurizable ink chamber 61 is pressurized through the diaphragm portion 60 of the vibration plate 57 and the pressure in the ink chamber 61 increases. As a result, an ink drop is ejected from the nozzle 64. At this time, the flowing of ink occurs even in the direction of the ink supplying paths 63, 63 communicating with the common ink chamber 62 from the ink chamber 61. The ink supplying paths 63, 63 each function as a fluid resistance portion by using the limited cross-sectional area of the ink supplying paths 63, 63 to suppress the flow the ink to the common ink chambers 62. Thereby, the efficiency of the ink ejection can be prevented from being decreased.

The pressure of the ink in the pressurized ink chamber 61 is decreased after completion of the ink drop ejection. A negative pressure occurs in the pressurized ink chamber 61 because of inertia of ink flowing therefrom and the discharging process of the drive pulse, and the ink filling process begins at this time. Then, the ink supplied from the ink tank flows into the common ink chambers 62. The ink in the common ink chambers 62, 62 further flows therefrom to the pressurizable ink chamber 61 through the ink supplying paths 63, 63 and fills the chamber 61. As a result, the vibration on the ink meniscus near the outlet of the nozzle 64 is attenuated and the ink surface is returned to a position near the outlet of the nozzle 64 by the action of surface tension and the ink surface is put in a stable state. The operation advances to the next ink drop ejection operation.

Figure 7:
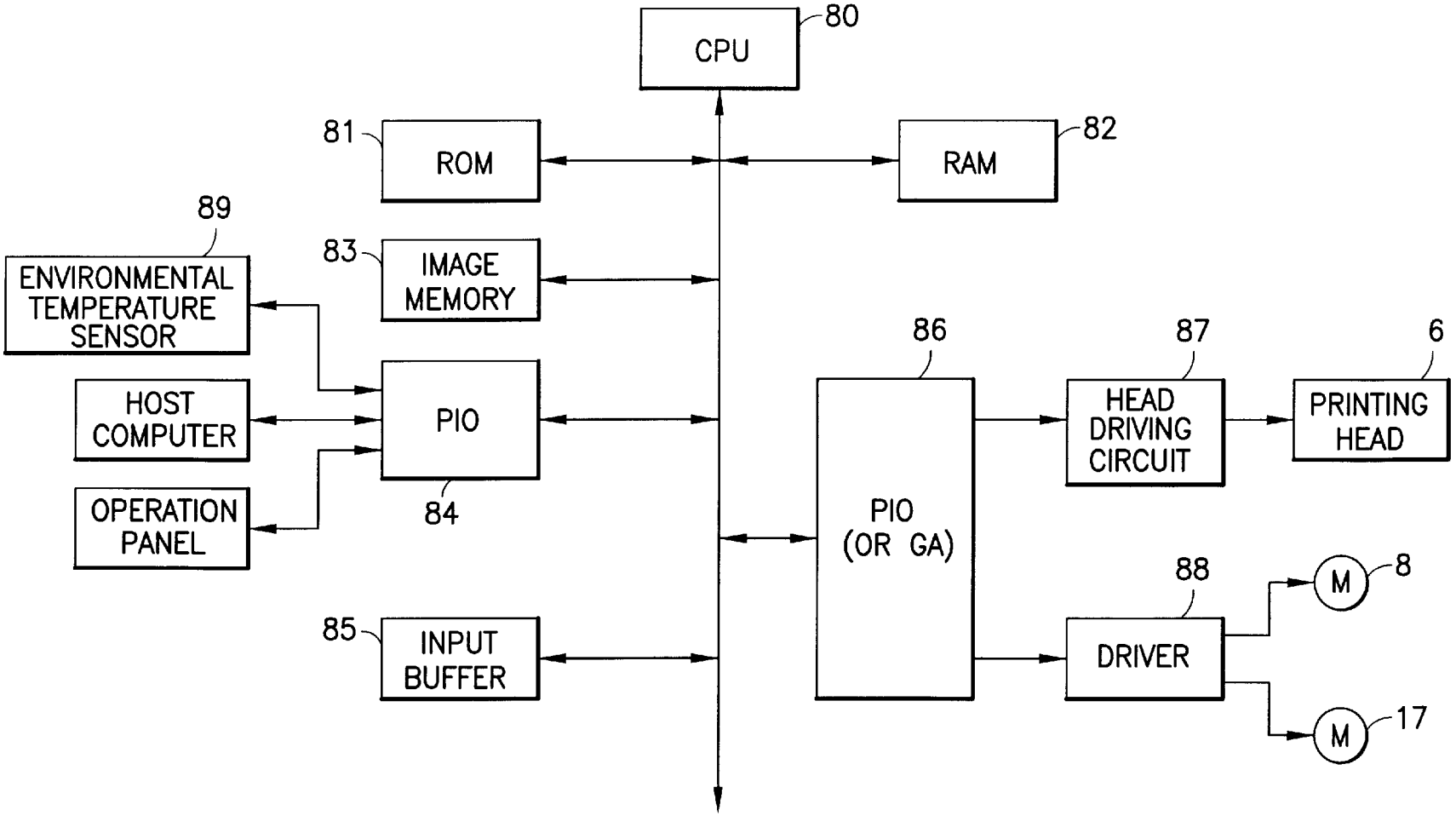
FIG. 7 is a block diagram showing the control section of the ink jet printing apparatus of FIG. 1.

Next, the outline of a control section in the ink jet printing apparatus is described, referring to FIG. 7.

The control section includes a microcomputer (hereinafter, referred to as "CPU"80) performing the control of the entire ink jet printing apparatus, a ROM 81 storing the necessary fixing information such as a table having parameters of the head property and environmental temperature for deciding the predetermined latch timing relating to preferred embodiments of the present invention, a RAM 82 used as the working memory, an image memory 83 for storing the data which processes the image information, a parallel input/output (PIO) port 84, an input/output buffer 85, a gate array (GA) or a parallel input/output (PIO) port 86, a head driving circuit 87, and a driver 88. The ink jet printing head 6 is driven by the head driving circuit 87. The main scanning motor 8 and the subscanning motor 17 are driven by the driver 88.

Figure 29:
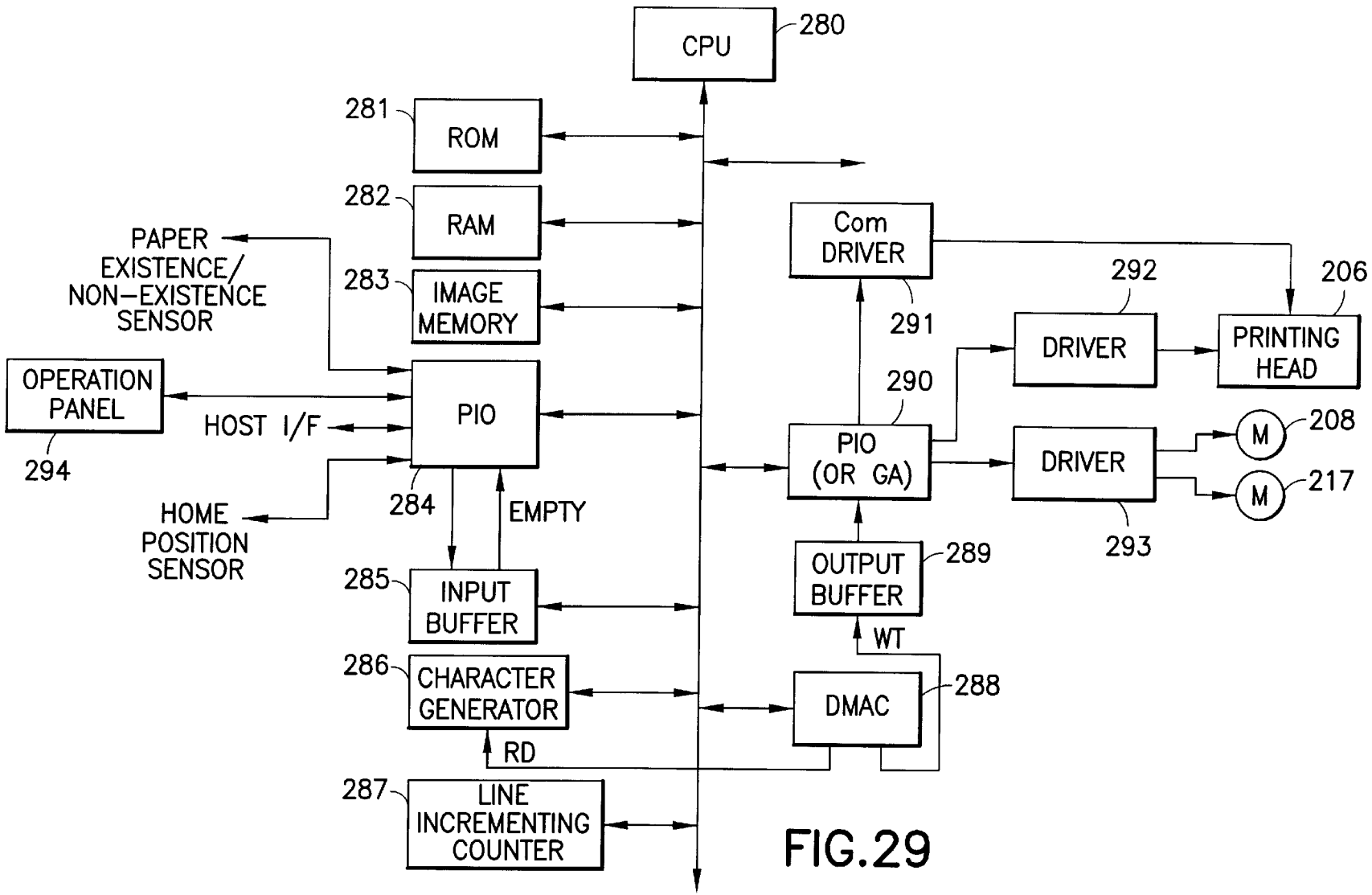
FIG. 29 is another block diagram showing the control section of the ink jet printing apparatus of FIG. 7.

Next, the outline of another control section in the ink jet printing apparatus is described, referring to FIG. 29.

The control section includes a CPU 280 performing the control of the entire ink jet printing apparatus, a ROM 281 for storing the necessary fixing information, a RAM 282 used as the working memory, an image memory 283 for storing the data which processed the image information, a parallel input/output (PIO) port 290, an input/output buffer 285, a character generator 286, a line incrementing counter 287, a DMAC 288, an output buffer 289, a PIO (or GA) 290 and a Com driver 291. The operation of the aforementioned elements is controlled by the operation panel 294. The ink jet printing head 206 is driven by the head driving circuit 291. The main scanning motor 208 and the subscanning motor 217 are driven by the driver 291.

Various data transmitted from the various sensors such as printing image data from a connected host computer, an environmental temperature detecting signal from the environmental temperature sensor 89 for detecting the environmental temperature, data such as recording, paper sort recognizing data showing the sort of the recording paper, various indication information from the operation panel seen in FIG. 7, a detection signal from the paper existence/non-existence sensor for sensing the start edge and the end edge of the recording paper seen in FIG. 29, and the signals from various sensors such as a home position sensor for detecting the home position (standard position) of the carriage 5 are input to the PIO port 84 or 284. Furthermore, necessary information is sent out to the connected host computer and to the operation panel through the PIO port 84 and 284.

Furthermore, the head driving circuit 87 applies a drive waveform which is an ink ejection driving waveform to the piezoelectric element 45 of the drive nozzle, which is an ink drop ejecting nozzle, corresponding to the image information and printing image data in the respective piezoelectric elements corresponding to the respective nozzles 64 of the printing head 6 in accordance with various sorts of data and signals applied thereto through the PIO port 86. The circuit 87 further applies a non-ejection driving waveform, having drive energy which is of such an amount for not ejecting the ink drops, to the piezoelectric element of the nozzle 64, corresponding to the preliminary drive data in the respective nozzles 64 of the recording head 6. Moreover, for the drive waveform, a rectangular waveform pulse, a triangle waveform pulse, and other pulses such as a sine (sinusoidal) wave can be used.

Furthermore, the driver 88 respectively drives and controls the scanning motor 8 and the subscanning motor 17 in accordance with the drive data applied thereto through the PIO port 86. Thereby, the driver 88 moves and scans the carriage 5 in the main scanning direction, and rotates the platen roller 15 in order to move the recording paper 16 by a predetermined amount in the subscanning direction.

Next, the section relating to the head drive control in the control section (hereinafter, called "head drive circuit") is described hereinafter, referring to FIG. 8. Only the section relating to one head is shown in FIG. 8.

Figure 8:
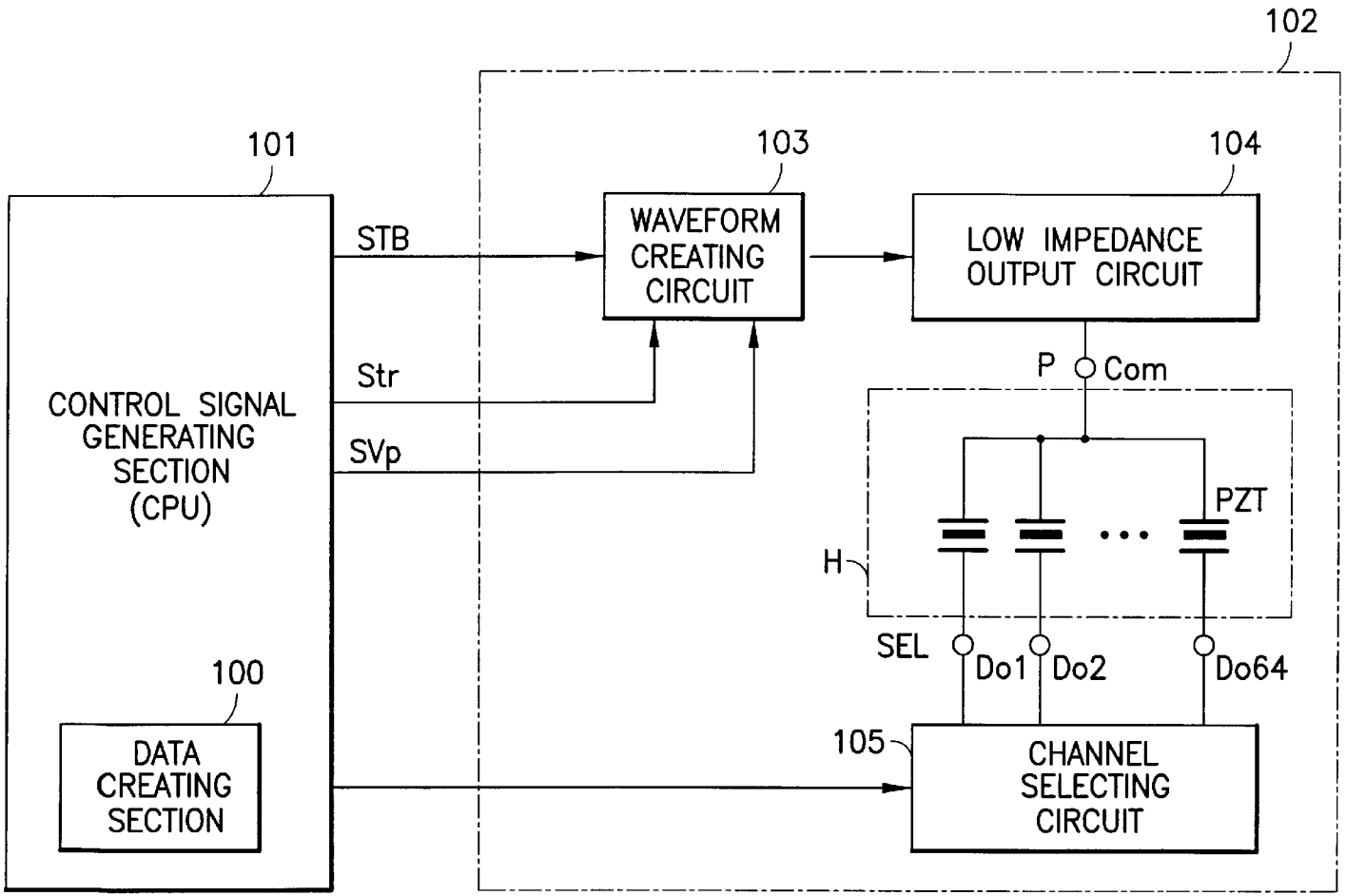
FIG. 8 is a block diagram showing the head driving circuit of the control section shown in FIG. 7.

The ink jet head H comprising the printing head 6 preferably includes 64 energy generating media which preferably are piezoelectric elements designated in FIG. 8 as PZT and correspond to plural nozzles 64 (for example, 64 nozzles), as mentioned above. Respective first electrodes of the respective piezoelectric elements PZT are connected to each other as a common electrode Com. Respective second electrodes of the respective piezoelectric elements PZT are individualized as the selection electrodes designated as SEL in FIG. 8 and as 55 in FIG. 4 for each of the respective piezoelectric elements PZT. Moreover, in practice, since the plural nozzles 64 are arranged in two rows, the ink jet head has 128 nozzles.

The head driving circuit 87 for driving and controlling the ink jet head is provided with the aforementioned CPU 80 and a data creating section 100 for creating the print data or image data, and the head driving section 102 for driving the ink jet head H.

The head driving section 102 includes a waveform creating circuit 103 for inputting the standard timing pulse from the control signal generating section 101 and creating and outputting the drive waveform, a low-impedance output circuit 104 for outputting the drive waveform P output from the waveform creating circuit 103 to the common electrode Com of the ink jet head H, and a channel selecting circuit 105 for applying the selection signals Do1~Do64 to the plural piezoelectric elements PZT of the ink jet head H.

The waveform creating circuit 103 can be constructed with, for instance a ROM, a D/A converter or other pulse generating circuit, and a waveform deforming or transforming circuit, or other suitable elements. A standard timing signal STB, a Vp controlling signal SVp for selecting a voltage Vp of the drive waveform P, and a tr controlling signal Str for selecting the leading edge time constant tr of the drive waveform P are input into the waveform creating circuit 103, and the drive energy can be changed by such control signals. Furthermore, the low-impedance output circuit 104 includes a low-impedance amplifier constructed with a buffer amplifier, an SEPP (Single Ended Push Pull), or other suitable components.

One example of the waveform creating circuit 103 and the low-impedance output circuit 104 is described hereinafter, referring to FIGS. 9 through 12.

Figure 9:
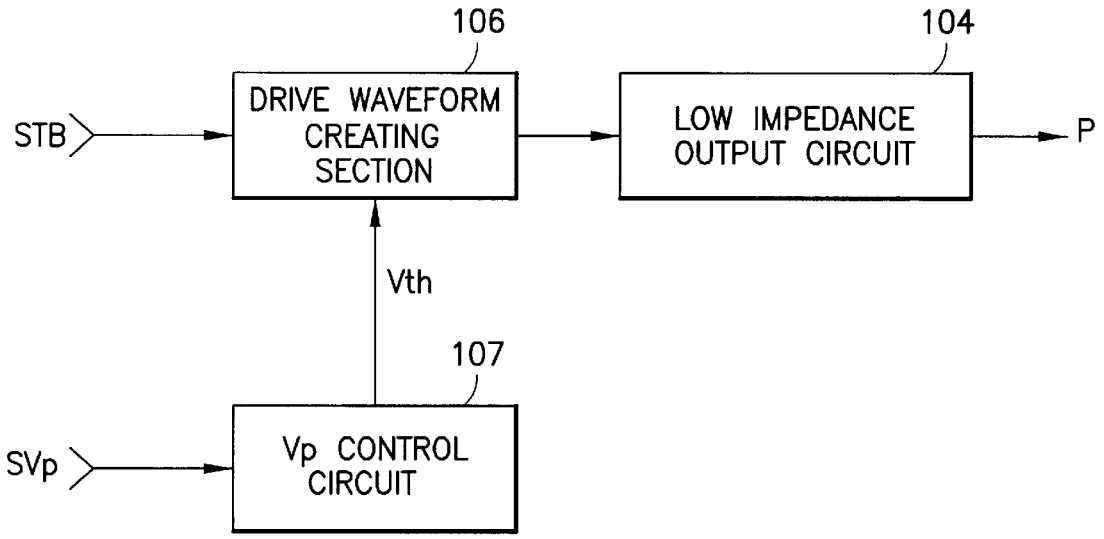
FIG. 9 is a block diagram showing an example of a waveform generating circuit of the head driving circuit of FIG. 8.

At first, as shown in FIG. 9, the waveform creating circuit 103 is constructed with a drive waveform creating section 106 for inputting the standard timing pulse STB, creating the drive waveform P, and applying the drive waveform P thus created to the low-impedance output circuit 104, and a Vp controlling section 107 for creating the voltage Vth which determines the voltage Vp of the drive waveform P of the drive waveform creating section 106 in accordance with the Vp controlling signal SVp and outputting the voltage Vth thus created. Moreover, a constant voltage driving circuit is defined by the drive waveform creating section 106 and the low-impedance output circuit 104.

Figure 10:
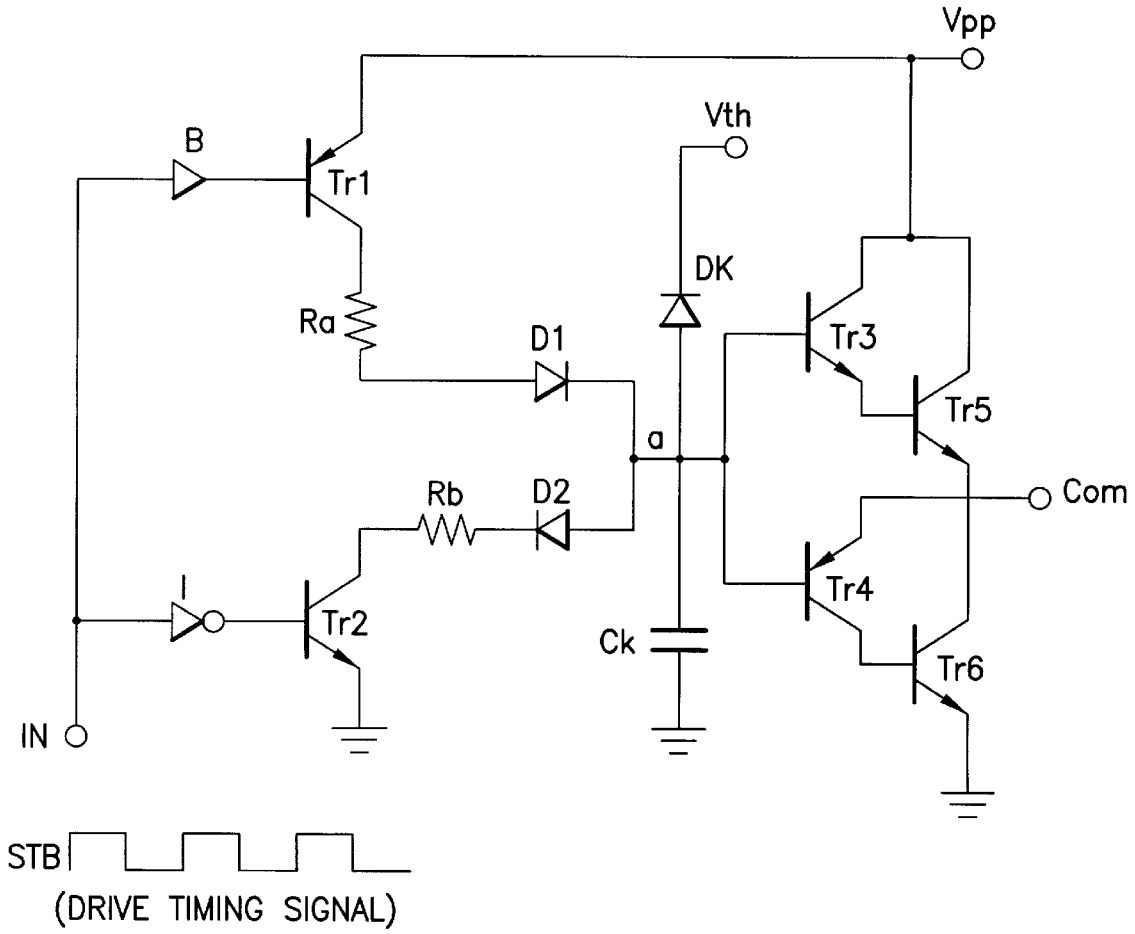
FIG. 10 is a circuit diagram showing an example of a drive waveform generating section and low impedance output circuit.

An example of the drive waveform creating section 106 and the low-impedance output circuit 104 is described, referring to FIG. 10. The input terminal IN which receives the standard timing pulse STB is connected to the base of the transistor Tr1 through a buffer B and the same terminal IN is connected to the base of the transistor Tr2 through the inverter I. The power source voltage Vpp is applied to the collector of the transistor Tr1 and the emitter of the transistor Tr2 is connected to the ground (GND).

Furthermore, a series circuit of a charging resistor Ra and a diode D1 is connected to the emitter of the transistor Tr1. The series circuit of a discharging resistor Rb and the diode D2 is connected to the collector of the transistor Tr2.

The cathode side of the diode D1 is connected to the anode side of the diode D2. A capacitor CK is connected between the junction point "a" of those two terminals and the ground (GND). The charging resistor Ra and the capacitor CK constitute the time constant circuit at the time of charging, and the discharging resistor Rb and the capacitor CK constitute the time constant circuit at the voltage vth which is applied to the above-mentioned junction point a through the diode Dk.

The junction point a is connected between the base of the transistor Tr3 which is located at the input side of the low-impedance output circuit 104 including the transistors Tr3~Tr6 and the base of the transistor Tr4. The drive waveform obtained between the emitter of the transistor Tr5 which is at the output side of the low-impedance output circuit 104 and the collector of the transistor Tr6 is output and applied to the common electrode Com of the ink jet head.

In the circuit described above, when the standard timing pulse (drive timing signal) STB is input to the input terminal IN and the "H" level is input to the buffer B, the buffer B outputs the voltage having a level lower than the power source voltage Vpp, and thereby the transistor Tr1 is turned on. At this time, the state of the inverter I becomes "L" and the transistor Tr2 is turned off. Consequently, the charging of the capacitor CK is started by the power source voltage Vpp with the charging time constant determined by the charging resistor Ra and the capacitor CK.

At this time, since the voltage Vth is applied to the junction point a through the diode DK (falling-down voltage thereof is Vd), the charging voltage of the capacitor CK does not rise up to the level of the power source voltage Vpp. Instead, the charging voltage of the capacitor CK is latched to the level of the voltage level (Vth+Vd). At this time, the voltage turns out to be equal to the maximum value (Vp=Vth+Vd) of the drive voltage Vp of the drive waveform P.

Furthermore, when the inputting of the standard timing pulse STB to the input terminal IN is stopped and the voltage of "L" level is input to the buffer B, the output of the buffer B becomes equal to the power source voltage Vpp. As a result, the transistor Tr1 is turned off. Since the output of the inverter I is inverted from the output of the buffer B, the transistor is put in an OFF state and at the same time the transistor Tr2 is put in an ON state. At this time, the discharging of the capacitor CK charged to the level of the voltage Vp is started with the discharging time constant determined by the discharging resistance Rb and the capacitance of capacitor CK.

Figure 11:
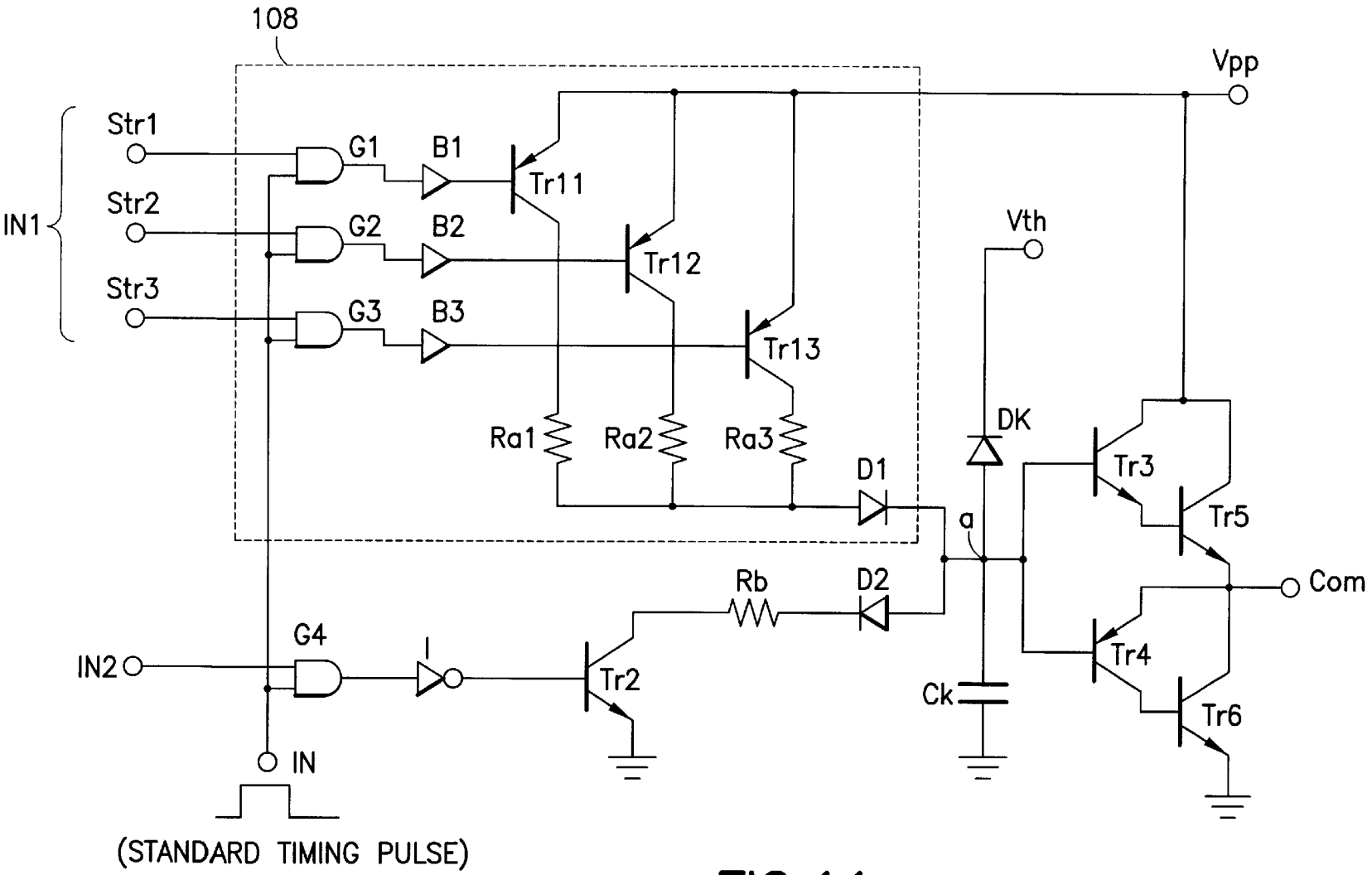
FIG. 11 is a circuit diagram showing another example of the drive waveform generating section and the low impedance output circuit.

Next, another example of the drive waveform creating section 106 and the low-impedance output circuit 104 is described, referring to FIG. 11.

The standard timing pulse STB is applied to the input terminal IN of the gate circuits G1~G3 as one input signal. The control signals IN1 (Tr control signals Str1~Str3) from the control signal generating section 101 (CPU 80) are respectively applied to the gate circuits G1~G3 as the other input signal. The gate circuits G1~G3 are respectively connected to the respective bases of the transistors Tr11~Tr13 through the buffers B1~B3. The power source voltage Vpp is applied to the collectors of the respective transistors Tr11~Trl3. The charging resistors Ra1~Ra3 are connected to the emitters of the respective transistors Tr11~Trl3. The parallel circuit of the charging resistors Ra1~Ra3 is connected in series to the diode D1. The Tr control circuit 108 for controlling the rising up (leading edge) time constant tr of the drive waveform is constructed with the above-mentioned elements.

The gate circuit G4 having an input terminal IN which receives the standard timing pulse STB as the one input signal and another input terminal IN2 which receives the control signal from the control signal generating section 101 as the other input signal is connected to the base of the transistor Tr2 through the inverter I. The emitter of the transistor Tr2 is connected to the ground (GND). The parallel circuit of the discharging resistor Rb and the diode D2 is connected to the collector of the transistor Tr2. The cathode side of the diode D1 is connected to the anode side of the diode D2. The capacitor CK is connected between the junction point a of the two sides and the ground (GND).

The time constant circuit at the time of charging is constructed with a charging resistor Ra selected from the charging resistors Ra1~Ra3 and the capacitor Ck. On the other hand, the time constant circuit at the time of discharging is defined by the discharging resistor Rb and the capacitor Ck. The voltage Vth from the Vp control section 107 is applied to the above-mentioned junction point a through the diode Dk.

The junction point a is connected between the base of the transistor Tr3 and the base of the transistor Tr4, both of which are located at the input side of the low-impedance output circuit 104 constituted by the transistors Tr3~Tr6. The drive waveform P output from the other junction point of the emitter of the transistor Tr5 and the collector of the transistor Tr6, both of which are located at the output side of the same low-impedance output circuit 104, is applied to the common electrode Com of the respective piezoelectric elements PZT of the ink jet head H.

In the above circuit, when any one of the tr control signals Str1~Str3 from the control signal generating section 101 becomes "H"-level, any one of the gate circuits G1~G3 corresponding thereto is put into an open state. Furthermore, when the control signal IN2 from the control signal generating section 101 becomes "H"-level, the gate circuit G4 is put into an open state.

For instance, in case that the gate circuit G1 is put into the open state, when the standard timing pulse STB is input to the input terminal IN, the "H" level is input to the buffer B, and the buffer B outputs the voltage having a level lower than the power source voltage Vpp, and thereby the transistor Trll is turned on. On the other hand, the inverter I is put in the state of "L" and thereby the transistor Tr2 is put in the OFF state. Therefore, the charging of the capacitor Ck is started by the power source voltage Vpp with the charging time constant determined by the charging resistor Ral and the capacitor Ck.

Similarly, in the case of putting the gate circuit G2 in the open state, the transistor Trl2 is turned on. At this time, the charging of the capacitor Ck is started with the charging time constant determined by the charging resistor Ra2 and the capacitor Ck. When that the gate circuit G3 is put in the open state, the transistor Tr13 is turned on. At this time, the charging of the capacitance Ck is started with the charging time constant determined by the charging resistor Ra3 and the capacitor Ck. Since the tr control signals Str1~Str3 are three-bit signals, eight levels of resistance values of the charging resistors can be selected according to the combination thereof by increasing the number of the bit becoming "H" at the same time.

When the charging of the capacitor Ck is performed in such a way, the voltage Vth is applied to the junction point a through the diode Dk (falling-down voltage Vd). Consequently, the charging voltage of the capacitor Ck does not rise up to the level of the power source voltage Vpp. In accordance with the property of the diode Dk, the charging voltage of the capacitor Ck is latched to the level of the voltage Vp (Vp=Vth+Vd). At this time, the voltage Vp becomes a maximum value of the drive waveform P.

Thereafter, when the inputting of the standard timing pulse STB to the input terminal IN is stopped, for instance, if the gate circuit G1 is put in the open state, the "L" level is input into the buffer B1. Thereby, the output of the buffer B1 becomes equal to the power source voltage Vpp and the transistor Tr11 is turned off.

Since the output of the inverter I becomes "H", the transistor Tr11 is turned off and at the same time, the transistor Tr2 is turned on. At this time, the discharging of the capacitor Ck charged to the level of the voltage Vp is started with the discharging time constant determined by the discharging resistor Rb and the capacitor Ck. Even when the gate circuit G2 or the gate circuit G3 is in an open state, the situation is same as described above.

Consequently, by charging the voltage Vth to be applied to the drive waveform creating section 106, the drive voltage Vp of the drive waveform P can be controlled so as to change the value thereof. Furthermore, any one of three levels of the drive waveform corresponding to any one of the rising-up (leading edge) time constants tr1, tr2, and tr3 can be selected in accordance with the tr control signals Str1~Str3, and the drive waveform thus selected can be created and output.

Figure 12:
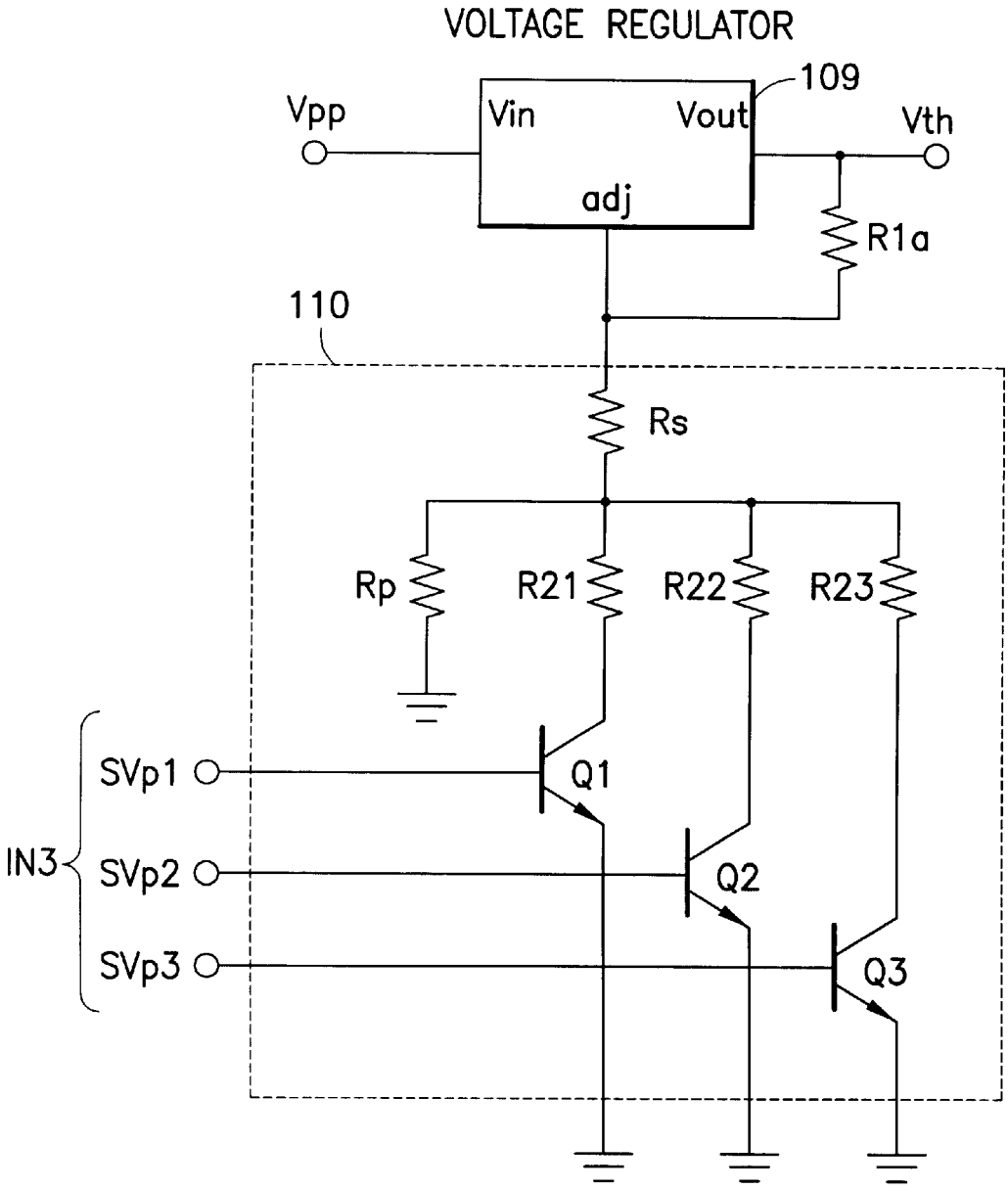
FIG. 12 is a block diagram showing an example of the Vp control section.

Next, as shown in FIG. 12, the Vp control section 107 is preferably constructed with a three-terminal regulator 109 and a resistor selecting circuit 110. By applying the voltage of the constant voltage power source to the input terminal Vin, the three-terminal regulator 109 outputs the voltage Vth corresponding to the resistance value R1 of the resistor R1a connected between the adjustment terminal adj and the voltage output terminal Vout and the resistance value R2 of the resistor selecting circuit 110 connected between the adjustment terminal adj and the ground (GND) from the voltage output terminal Vout. For instance, a product such as LM317T made by National Semiconductor Co., Ltd. can be used as this voltage regulator 109. The output voltage Vth from the three-terminal regulator 109 turns out to be determined, for instance, by the following equation:

$$Vth=1.250\times(1+R2/R1)$$

The resistor selecting circuit 110 is constructed with a circuit including a series connection of the resistor Rs and the parallel circuit of the resistor Rp and one of the resistors R21~R23 selected by the switching transistors Q1~Q3. For instance, the resistor selecting circuit 110 can be constructed by use of SN7406 (Name of Product) made by Texas Instruments, Inc. In the resistor selecting circuit 110, the control signals IN3 which include Vp control signals SVp1~SVp3 from the aforementioned control signal generating section 101 are respectively input to the bases of the transistors Q1~Q3.

In such a situation, the power source voltage Vpp is applied to the three-terminal regulator 109, and at the same time, the three-bit Vp control signals SVp1~SVp3 are applied to the resistor selecting circuit 110 from the control signal generating section 101. Thereby, the output voltage Vth of the three-terminal regulator can be changed with a maximum of eight voltage levels. By inputting the output voltage Vth as the voltage vth of the aforementioned drive waveform creating section 106, the drive voltage Vp of the drive waveform can be set to a predetermined value.

Moreover, for instance, by use of the voltage-dividing circuit in which the resistor and the parallel circuit of the variable resistor and the capacitor are connected in series and the voltage across both of the terminals of the capacitor is output as the voltage Vth, the creation of the different voltages Vth can be performed by changing the resistance value of the variable resistor. The voltage Vth can be also changed even by use of the D/A converter. Furthermore, the control signal generating section 101 including the CPU 80 outputs the control signals IN1~IN3 by referring to the table previously stored in the ROM 81.

Figure 13:
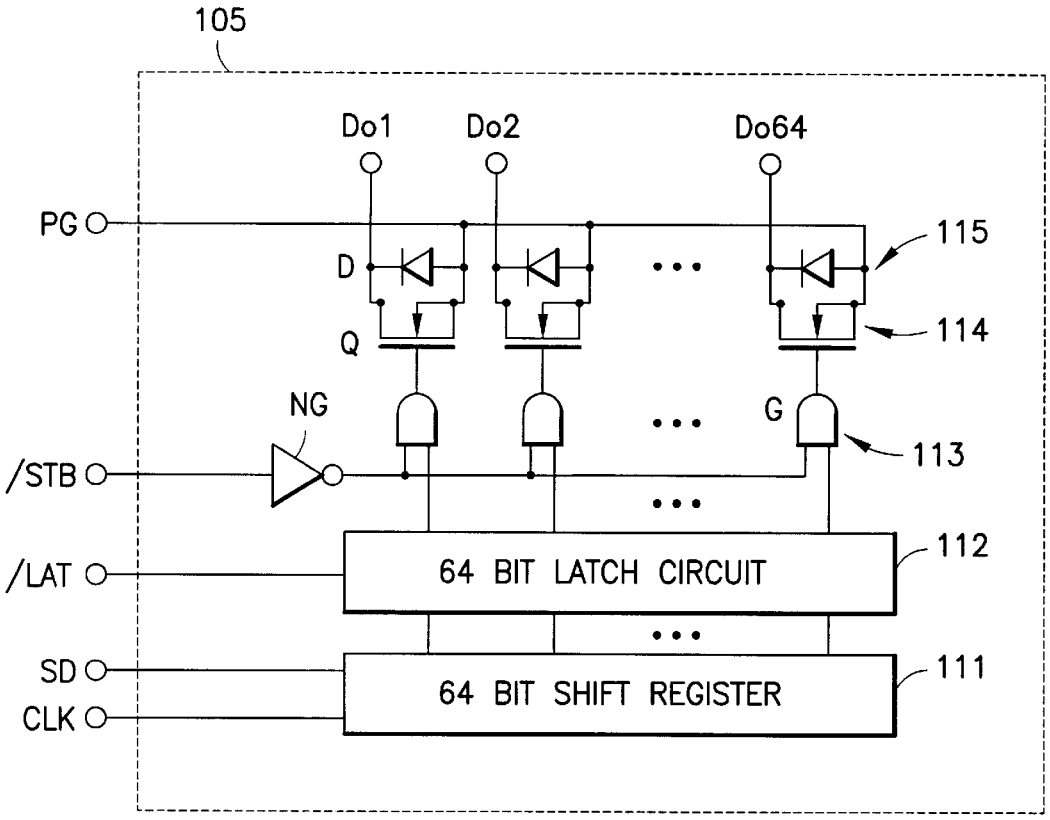
FIG. 13 is a block diagram showing an example of a channel selecting circuit of the head driving circuit of FIG. 8.

Next, the channel selecting circuit 105 is described, referring to FIG. 13. The channel selecting circuit 105 preferably includes a 64-bit shift register 111 having a capability of storing bits of a number equal to or greater than the number m of the nozzles (for example, here, m=64), in which the serial input SD is received with the clock signal CLK, a 64-bit latch circuit 112 for latching the registered value in the shift register 111 with the latch signal "/" (here, the symbol "/" signifies the inversion), a gate circuits group 113 including the gate circuit G corresponding to the respective piezoelectric elements PZT. One input terminal of the gate circuits G receives the output of the latch circuit 112, and another input terminal Qt the gate circuits G receives the standard timing signal "/STB" through the NOT circuit NG, a transistor array 114 including respective transistors Q corresponding to the respective piezoelectric elements PZT. The transistors Q are turned on or off by the outputs of the respective gate circuits G and a diode array 115 including the diodes connected to the respective transistors Q.

The printing data (serial data) SD to be input to the serial input terminal along with the timing pulse CLK are received at the shift register 111. The latch circuit 112 latches the signal received at that time with the latch signal "/LAT". The standard timing signal "/STB" from the control signal generating section 101 opens the desired gate circuit G, and thereby turns on the transistor Q and outputs the selection signal Don (n=1~64). Finally, the drive waveform P from the low impedance output circuit 104 is applied to the piezoelectric elements PZT in order to drive those elements.

Next, the function of the ink jet printing apparatus constructed in the above-mentioned way is described hereinafter, referring to FIG. 14 and subsequent drawings.

In order to clarify the drive control method according to preferred embodiments of the present invention, it is necessary to recognize that in conventional methods of driving the ink jet head of the ink jet printing apparatus, the drive waveform is applied only to the energy generating medium of the drive nozzles selected for ejecting an ink drop, and the drive waveform is not applied to the energy generating medium of the non-drive nozzles which are not ejecting an ink drop. The conventional method of driving an ink jet head is described in more detail, referring to FIGS. 14–17.

Figure 14:
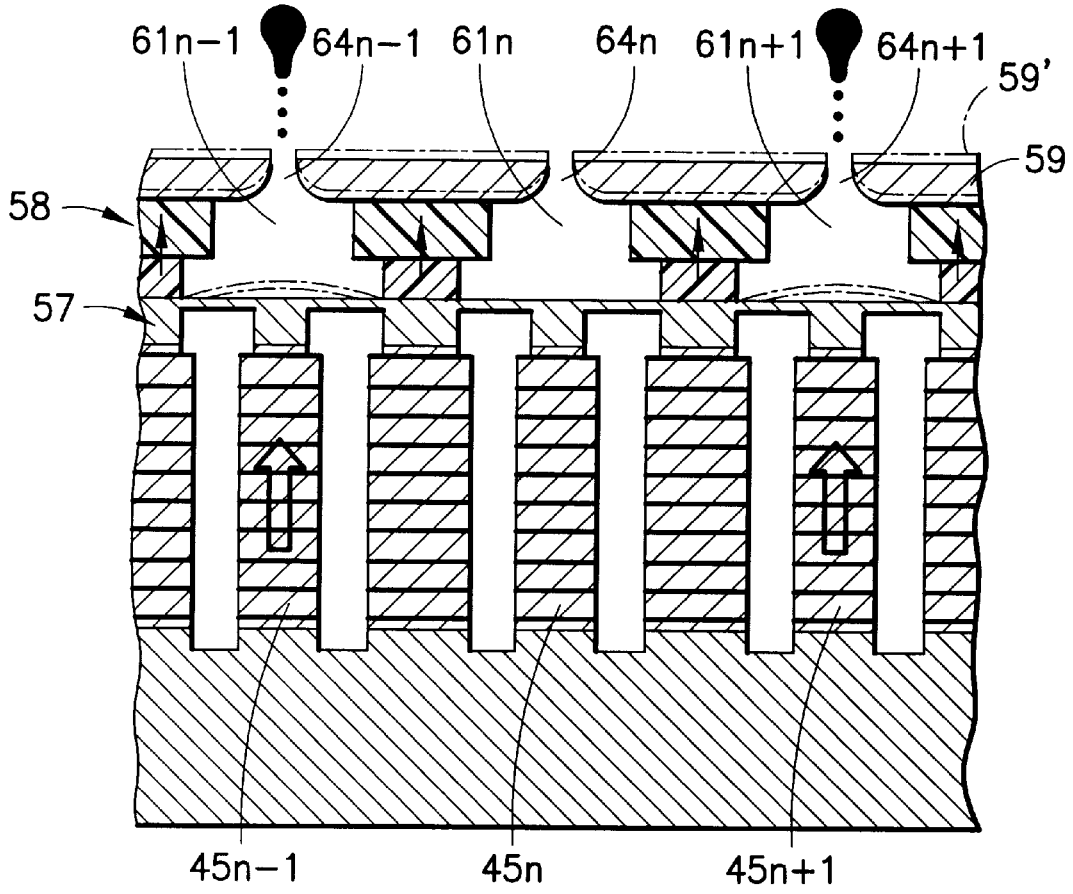
FIG. 14 is a cross-sectional view showing the main part for explaining an example of the volume increase of the ink chamber between the adjacent channels utilizing a conventional method of driving.
Figures 15A, 15B, 15C, 15D, 15E, 15F, 15G, 15H, 15I:
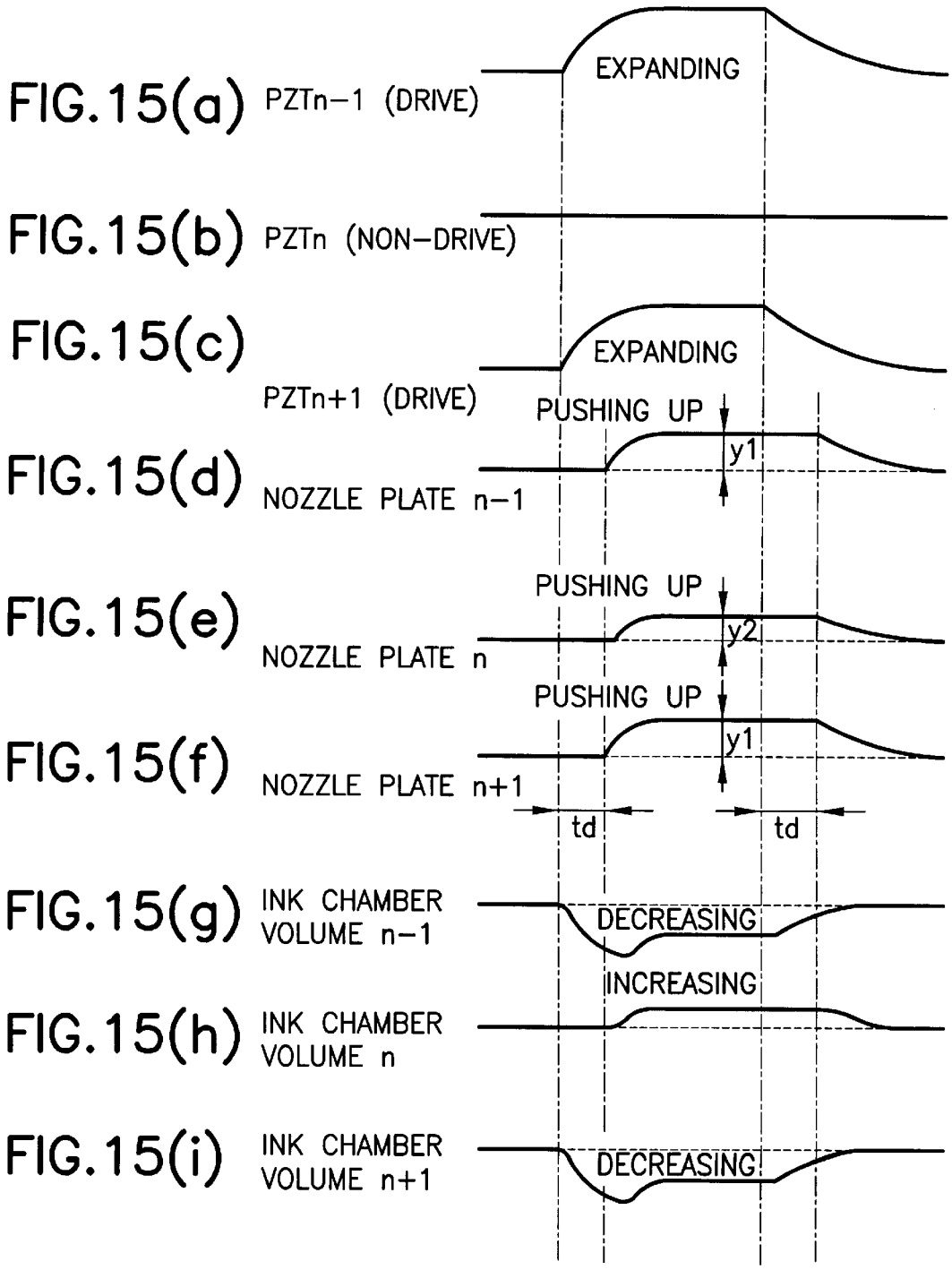
FIGS. 15(*a*) through 15(*i*) are explanatory diagrams for explaining the changes of the respective parts in the case of utilizing the conventional method of driving.

At first, assuming that the central channel n shown in FIG. 14, of the plural channels (nozzles) 64 arranged adjacent to each other is a non-drive nozzle, and the channels n−1 and n+1 are drive nozzles, the drive waveform is respectively applied to the piezoelectric elements 45n−1 and 45n+1 corresponding to the respective drive nozzles 64n−1 and 64n+1, while the drive waveform is not applied to the piezoelectric element 45n corresponding to the non-drive nozzle 64n, as shown in FIGS. 15(*a*) through 15(*c*).

At this time, since the piezoelectric elements 45n−1 and 45n+1 both having the drive waveform applied thereto expand by almost 0.1 mm and thereby lift up the diaphragm portion 60 of the vibrating plate 57 as shown in FIG. 14, the volume of the ink chambers 64n−1 and 61n+1 is reduced as shown in FIGS. 15(*g*) through 15 (*i*). Thereby, the ink drops are respectively ejected from the drive nozzles 64n−1 and 64n+1.

During the time period of performing the process of ink ejecting, the ink chamber partition member 58, including the first photosensitive resin layer 68 and the second photosensitive resin layer 69, is slightly raised up. Consequently, the nozzle plate 59 is lifted up to the position of the nozzle plate 59' represented by the dot-dash lines in FIG. 14. For this reason, as shown in FIGS. 15(*d*) through 15(*f*), the nozzle plate 59 starts to displace after a delay time from the starting time of applying the drive waveform td, which delay time td is caused by the pressure propagation time of the nozzle plate 59. The parts of the drive channels n−1, n+1 are pushed up by the displacement amount y1 The part of the non-drive channel n is also pushed up by the displacement amount y2. According to this example, it could be recognized that the displacement of the nozzle plate 59 was almost ¼ of the displacement of the piezoelectric element 45.

In such a way, by driving the piezoelectric elements of the drive nozzles at the right and left sides of the selected non-drive nozzles, the nozzle plate portion n of the ink chamber 61n of the non-drive nozzle 64n is uniformly lifted up. However, since the drive waveform is not applied to the piezoelectric element 45n of the non-drive nozzle 64n, the diaphragm portion of the corresponding vibration plate 57 is not deformed.

For this reason, the inner volume of the ink chamber 61n of the non-drive nozzle 64n increases as shown in FIG. 15(*h*), and thereby, the surface of the ink meniscus of the non-drive nozzle 64n is sucked into the ink chamber 61n by the volume increase of the chamber 61n. If such phenomenon repeatedly occurs, air is also sucked into the ink chamber 61n.

Figure 16:
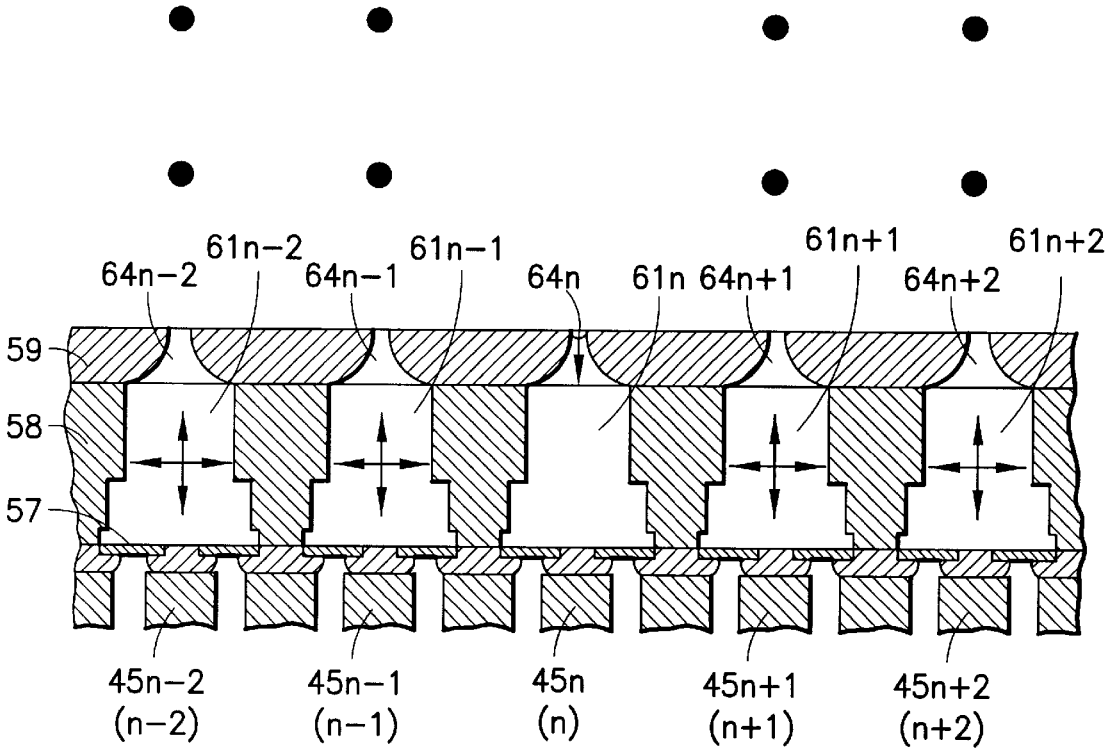
FIG. 16 is a cross-sectional view showing the main part for explaining another example of the volume increase of the ink chamber between the adjacent channels utilizing the conventional method of driving.

Such phenomenon occurs also when a plurality of nozzles on each side of the designated non-drive nozzle are drive nozzles as shown in FIG. 16. The partition member 58 of the ink chamber of FIG. 16 includes multiple layers as described above and the same reference numerals used in FIG. 5 are used in FIG. 16 to indicate like elements. As shown in FIG. 16, the central channel n is surrounded by a plurality of nozzles. At each of the two sides of the central channel n which is a non-drive nozzle are two channels n−2, n−1, n+1, n+2 which are drive nozzles. The drive waveform is applied to the piezoelectric elements 45n−2, 45n−1, 45n+1 and 45n+2 of the drive nozzles 64n−2, 64n−1, 64n+1 and 64n+2, in order to respectively eject an ink drop from the drive nozzles, and the drive waveform is not applied to the piezoelectric element 45n of the non-drive nozzle 64n. At this time, the piezoelectric elements 45n−2, 45n−1, 45n+1, and 45n+2, all have the drive waveform applied thereto and are displaced at the same time, and the diaphragm portion of the vibration plate 57 is lifted up. Consequently, the volumes of the ink chambers 61n−2, 61n−1, 61n+1, and 61n+2, are respectively reduced, and thereby, the ink drops are respectively ejected from the drive nozzles 64n−2, 64n−1, 64n+1, and 64n+2.

When this process of ink ejecting is performed, since the partition member 58 in the ink chamber is slightly lifted up, the entire nozzle plate 59 is pushed up. For this reason, the nozzle plate 59 starts to displace when the delay time which is caused by the pressure propagating time of the nozzle plate 59 elapses from the starting of applying the drive waveform. At this time, the portions of the drive channels n−2, n−1, n+1, and n+2 are pushed up by the displacement amount y1, and even the portion of the non-drive channel n is pushed up by the displacement amount y2 (y2<y1).

Figure 17:
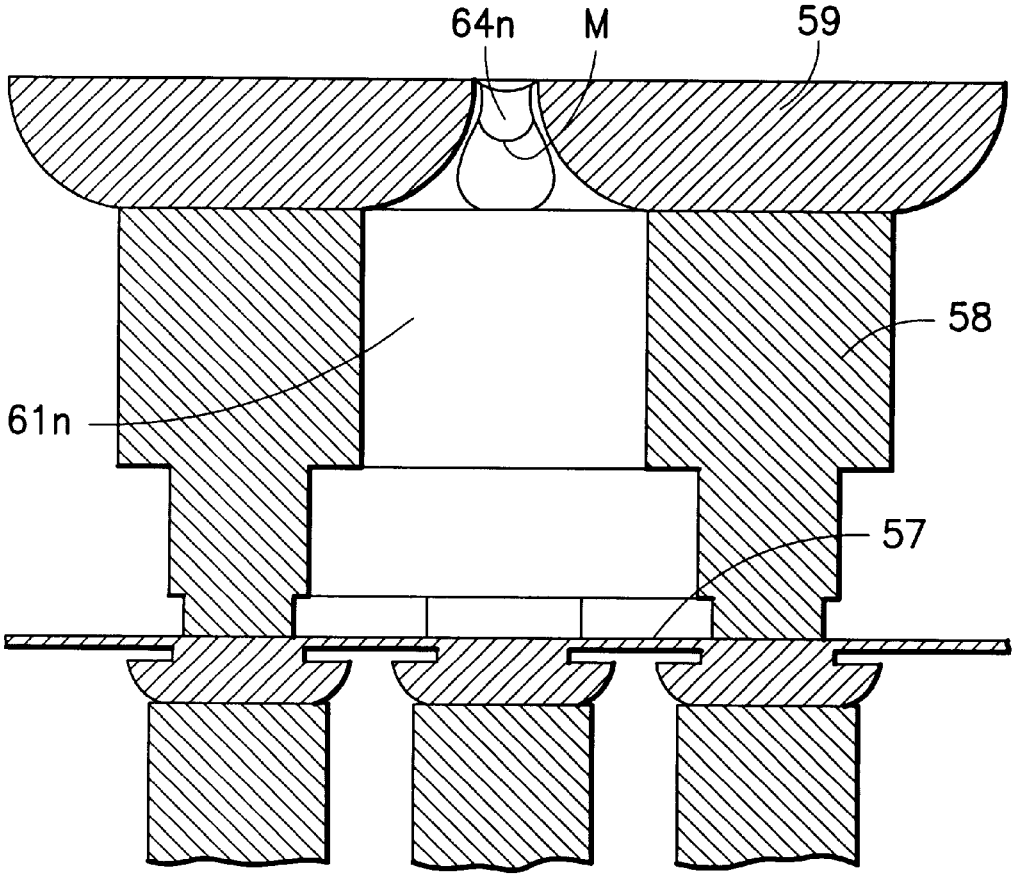
FIG. 17 is an enlarged view for explaining the variation of the meniscus surface of the non-drive nozzle shown in FIG. 16.

In such a way, even the nozzle plate portion of the liquid chamber 61n of the non-drive nozzle is uniformly lifted up. However, since the drive waveform is not applied to the piezoelectric element 45n of the non-drive nozzle, the inner volume of the ink chamber 61n of the non-drive nozzle 64n increases as shown in FIG. 17, and thereby, the ink meniscus surface M of the non-drive nozzle 64n is sucked inside by the amount of the volume increase. If such a phenomenon occurs repeatedly, the air is sucked into the ink chamber 61n.

As a result, even though when the non-drive nozzle later becomes a drive nozzle and a drive waveform is then applied to the piezoelectric element 45n, mis-ejection or insufficient ejection of an ink drop occurs due to the sucked air. Furthermore, even if the sucking of air described above does not occur, the meniscus surface M is sucked inside, and thereby, the positional deviation of the print starting dot(s) occurs easily.

In preferred embodiments of the present invention, a non-ejection driving waveform having a drive energy which is set for not ejecting an ink drop ig applied to all go the non-drive nozzles or some specified non-drive nozzles. The above type of drive is called a "preliminary drive".

Figures 18A, 18B, 18C, 18D, 18E, 18F, 18G, 18H, 18I:
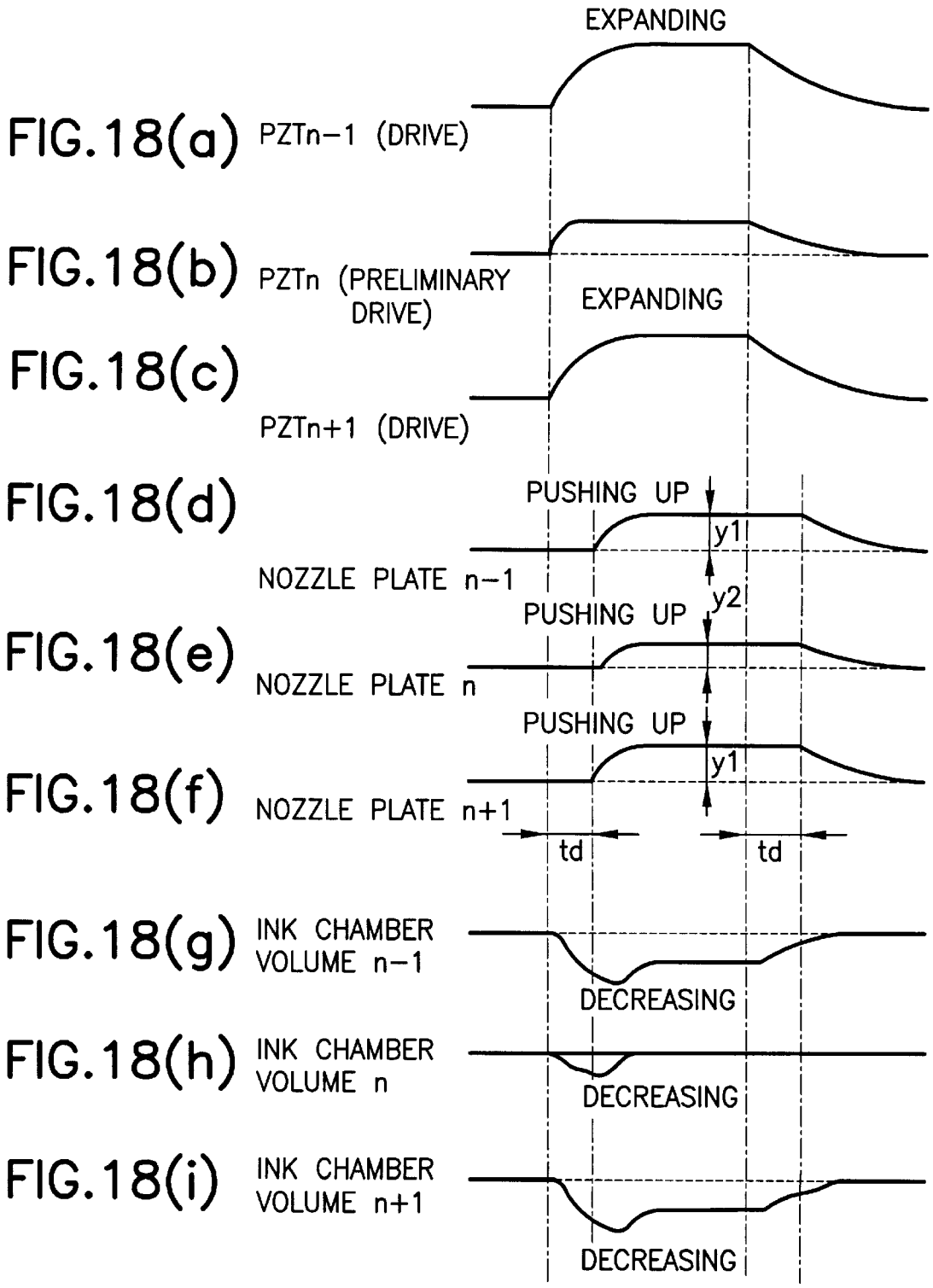
FIGS. 18(*a*) through 18(*i*) are explanatory diagrams for explaining the variation of the respective parts in the case of utilizing the head driving method according to a preferred embodiment of the present invention.

Referring to FIGS. 18(*a*)–18(*i*), assuming that the selected channel n is a non-drive nozzle and the adjacent channels n−1, n+1 at both sides of the channel n are drive nozzles, as shown in FIGS. 18(*a*) and 18(*c*), when the ejection driving waveform for ejecting the ink drop is applied to the piezoelectric elements of the drive channels n−1, n+1, the other drive waveform set for not ejecting the ink drop, that is, the non-ejection driving waveform, is applied to the piezoelectric element of the non-drive channel n with the same timing as shown in FIG. 18 (*b*).

On this occasion, when the preliminary driving is performed for the piezoelectric elements 45 of all non-drive nozzles, the drive waveform P is applied to all of the channels n−1, n, and n+1. The upper limit or maximum value of the drive waveform P applied to the non-drive channel n is reduced to about one half of the maximum value of the drive waveform P applied to the drive channels n−1 and n+1 as seen by comparing FIG. 18(*b*) to FIGS. 18(*a*) and 18(*c*). As a result, the ejection driving waveform which is the drive waveform P can be applied to the piezoelectric elements of the drive channels n−1, n+1, and the non-ejection driving waveform which is created by reducing the drive voltage of the drive waveform P is applied to the piezoelectric element of the non-drive channel n, Furthermore, it may be allowable that the non-ejection driving waveform set for not ejecting the ink drop to be applied to the non-drive channel is equal to or smaller than a drive waveform having an amount of energy which is not larger than a lower limit required for not ejecting the ink drop. Applying drive energy of an amount or level calculated for not ejecting the ink drop from the energy generating medium is called a "non-ejection drive" or a "preliminary drive".

In such a way, as shown in FIGS. 18(*g*) through 18(*i*), the volumes of the ink chambers of the drive channels n−1, n+1 are decreased, and thereby, the ink drops are respectively ejected from the nozzles. As shown in FIG. 18(*h*), although the volume of the ink chamber n is also decreased, the ink drop is not ejected therefrom according to the relationship with the drive energy. Thereafter, when the delay time t1 elapses from the starting of applying the drive waveform, the nozzle plate 59 is slightly lifted up and the volume of the ink chamber starts to increase as shown in FIGS. 18(*d*) through 18(*f*). However, since the volume of the ink chamber of the non-drive channel n is decreased as mentioned above, the above-described increased amount is cancelled thereby, and the state of the ink chamber of the non-drive channel returns to a substantially ordinary state and the volume of the ink chamber of the non-drive channel n does not increase at all. Consequently, the ink meniscus surface m of the non-drive channel n is not sucked at all into the ink chamber. As a result, the phenomenon of sucking air into the ink chamber does not occur at all in the non-drive channels.

In such a way, when the piezoelectric elements 45 are driven in accordance with the image data, by applying the non-ejection driving waveform having a drive energy set for not ejecting the ink drop to all of the piezoeletric elements of the non-drive nozzles, the phenomenon of sucking air into the ink chamber caused by the sucking the meniscus surface inside does not occur at all. Consequently, when the non-drive nozzle is changed to a drive nozzle, undesired ink ejection (mis-ejection or insufficient ejection) does not occur at all.

Moreover, in the above explanation, if the piezoelectric element of the designated channel is preliminarily driven when the printing image data coincides with the predetermined drive pattern, the drive waveform P is applied to all of the channels n−1, n, n+1, even when n is a non-drive channel n. As to the non-drive channel n, the upper limit of the drive waveform P has a reduced value compared to a voltage value of the drive waveform P applied to the drive channels n−1, n+1. As a result, the ejection driving waveform which is the drive waveform P can be applied to the piezoelectric elements of the drive channels n−1, n+1, and the non-ejection driving waveform created by reducing the drive voltage of the drive waveform P can be applied to the piezoelectric element of the non-drive channel n.

Furthermore, when the piezoelectric element of the non-drive channel is preliminarily driven when the printing image data coincides with the predetermined drive pattern, it is also possible that the ejection driving waveform and the non-ejection driving waveform are created previously and output therefrom. The non-ejection driving waveform is selectively applied to the piezoelectric element of the channel to be preliminarily driven, i.e. the non-drive channel.

Figures 19A, 19B, 19C, 19D:
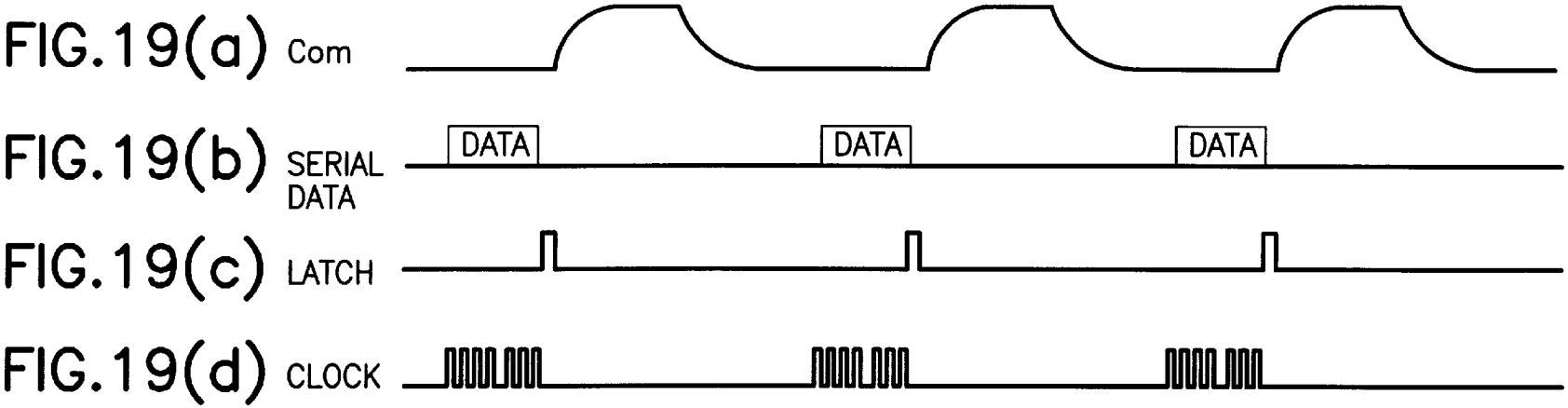
FIGS. 19(*a*) through 19(*d*) are explanatory diagrams for explaining the general operation of the channel selecting circuit.

Next, the control operation of driving the ink jet head at the time of preliminarily driving all of the channels is described, referring to FIGS. 19(*a*)–19(*d*) and 20(*a*)–20(*f*).

At first, in an ordinary situation, the drive waveform P is applied to the common electrode Com in accordance with the standard timing signal STB as shown in FIG. 19(*a*) . The n-bit serial data are sent together with the timing pulse shown in FIG. 19(*d*), as shown in FIG. 19(*b*). Thereafter, the latch signal is made active as shown in FIG. 19(*c*). As a result, the n-bit data of the shift register 111 are latched in the latch circuit 112 at the game time, and whether the drive waveform should be applied to each piezoelectric element PZT is determined.

In case that the aforementioned designated channel n is a non-drive channel, and the channel n−1, n+1 at both sides of the designated channel n are drive channels, the bit output of the selected channel n is "O", and thereby the transistor is put into an open state and thus is not conductive. The bit outputs of the channels n−1, n+1 at both sides of the designated channel n are both "1", and thereby, the transistor is put into a closed state in which the transistor is conductive.

In such a situation, according to preferred embodiments of the present invention, the data creating section 100 creates the preliminary drive data of all "1" for applying the signal representing the presence of the printing image data to all of the channels together with the printing image data, and creates the clock signal and the latch signal, both of which are necessary for transferring and latching the above preliminary drive data.

The drive waveform P is applied to the common electrode Com of the ink jet head as shown in FIG. 20 (*a*). The preliminary drive data are transferred as shown in FIG. 20(*b*), and latched in the latch circuit 112 from the shift register 111 with the latch signal shown in FIG. 20(*c*), and further shifted to the final-stage transistor array 114. In such a way, the application of the drive waveform P to the non-drive channel n and the drive channels n−1, n+1 is started as shown in FIGS. 20(*d*) through 20(*f*).

In addition to the above operation, as shown in FIGS. 20(*b*) and 20(*c*), the n-bit data corresponding to the printing image data are transferred to the shift register 111 with the clock signal after latching the preliminary drive data in the latch circuit 112. Thereafter, the latch signal is generated at the time when the delay time td from the start of the application of the drive waveform has elapsed. The printing data stored in the shift register 111 are latched in the latch circuit 112. The data corresponding to the printing data are shifted by the designated transistor Q in the transistor array 114.

For this reason, the bit of the non-drive channel n is changed to "O" by the data corresponding to the printing image data. In the non-drive channel n, as shown in FIG. 20(*e*), the switching transistor is put into a closed state by the preliminary drive data, and then the same switching transistor is put into a state of being opened at a midpoint of the rising-up time of the drive waveform P. Therefore, the electric potential of the drive waveform P at that time is kept at a value V1. Thereafter, when the drive waveform P falls down at the time of the trailing edge thereof, the discharging operation is performed by the diode connected in parallel with the transistor. As a result, a waveform that is lowered gradually can be provided as a non-ejection driving waveform.

Consequently, the volume of the ink chamber of the non-drive channel is decreased by starting the preliminary drive, and thereby, the resulting increase of the volume of the ink chamber of the non-drive channel as described above is cancelled by the above-mentioned volume decrease. Therefore, the state of the ink chamber of the non-drive channel returns to a substantially ordinary state, and the volume thereof does not change at all.

Next, an example of preliminary driving the specified non-drive channel when the printing image data coincides with the predetermined drive pattern is described hereinafter, referring to FIGS. 21 through 23.

There are many methods for the timing when the drive waveform set for not ejecting the ink drop, e.g., a non-ejection driving waveform, is be applied to the piezoelectric element of the non-drive nozzle.

For instance, between the adjacent plural channels, when the two surrounding nozzles n−1, n+1 adjacent to the designated non-drive nozzle n are drive nozzles, the non-drive nozzle n is preliminarily driven in a manner described above. When at least either one of the two nozzles n−1, n+1 adjacent to the designated non-drive nozzle n is also a non-drive nozzle, the designated non-drive nozzle is not preliminarily driven. This is a method according to a further preferred embodiment.

In such a way, by specifying the channel to be preliminarily driven, the power consumption can be reduced and the migration of the piezoelectric element can be prevented.

Figure 22:
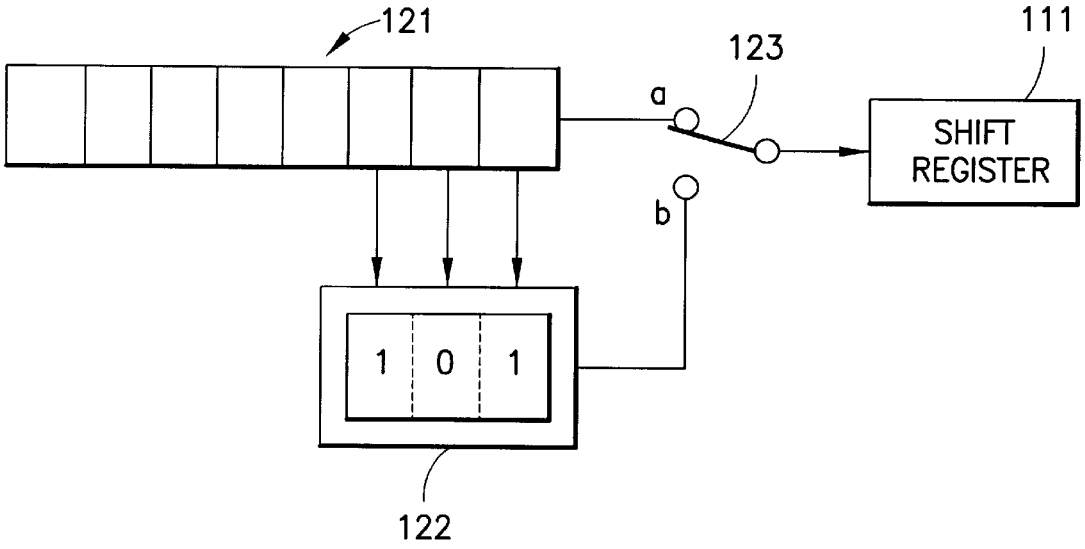
FIG. 22 is a block diagram showing an example of the circuit for preliminarily driving the selected non-drive channel.

The main part of the circuit for preliminarily driving the specified channel at the time of coinciding with the predetermined drive pattern is shown in FIG. 22.

The circuit includes an 8-bit parallel-serial converting medium 121 for converting the printing image data from a parallel signal to a series signal, a look-up table 122 for outputting the preliminary drive data on the basis of the data of the preliminary drive data of the predetermined bit of the parallel-serial converting medium 121, and the switching medium 123 for selectively changing over the data from the parallel-serial converting medium 121 and the data from the look-up table 122 and outputting the changed-over data to the shift register 111

The switching medium 123 is changed over to the side of the contact "b" at the time of transferring the preliminary drive data, and changed over to the side of the contact "a" at the time of transferring the next printing image data. Consequently, the 8-bit parallel-serial converting medium 121 operates twice for the preliminary driving and for the printing image data. Since the amount of data per one line is several thousands bits, the parallel-serial converting medium 121 operates several hundred times. Such operations are repeated twice, for creating the preliminary drive data and transferring the created data and for transferring the primary or essential printing image. In such a way, the preliminary driving can be done without any large-scaled change to the circuit.

Assuming that the look-up table 122 includes 3 bits, the table 122 is constructed such that, only when the printing image data coincide with the drive pattern of [1, 0, 1] (example of FIG. 21), the signal [1] is output to the designated non-drive channel (namely, the preliminary drive is performed). However, the present invention is not limited to such operation.

If the ink jet printing apparatus is provided with the circuit described above, the drive waveform P is applied to the common electrode Com of the ink jet head in accordance with the standard timing pulse STB. The preliminary drive data created by the look-up table 122 for driving the specified channel as shown in FIG. 23(*b*) is transferred, and the data thus transferred are latched from the shift register 111 to the latch circuit 112 with the latch signal shown in FIG. 23(*c*). The data latched in the latch circuit 112 are shifted to the final-stage transistor group 114. Thereby, the operation of respectively applying the drive waveform P to the non-drive channel n and the drive channels n−1, n+1 is started, as shown in FIGS. 23(*d*) through 23 (*f*).

Furthermore, although such operation has been already explained in FIG. 20, in addition, the n-bit data corresponding to the printing image data are transferred to the shift register 111 with the clock signal after the preliminary drive data are latched in the latch circuit 112, as shown in FIGS. 23(*b*) and 23(*c*). The latch signal is generated at a time when the delay time td from the start of applying the drive waveform has elapsed, and the printing data of the shift register 111 are latched in the latch circuit 112. The data corresponding to the printing data are shifted to the selected transistor in the transistors group 114 which is selected to be driven.

For this reason, the bit of the non-drive channel n is changed to "0" by the data corresponding to the printing image data. In the non-drive channel n, the switching transistor is closed by the preliminary drive data, and the same switching transistor is opened at a midpoint of the rising up period. The electric potential of the drive waveform P at that time is maintained at V1. Thereafter, the discharging of the diode connected in parallel with the transistor is done when the drive waveform falls down. In such a way, a gradually lowering waveform can be provided for a non-ejection drive waveform.

Next, the relationship between the timing of the latch signal for performing the preliminary drive and the drive voltage is described hereinafter, referring to FIG. 24.

As mentioned before, after latching the preliminary drive data and starting the operation of applying the drive waveform to the piezoelectric element, the latch signal for latching the printing image data is applied to the latch circuit 112, and thereby, the non-ejection driving waveform is produced.

Figures 24A, 24B, 24C:
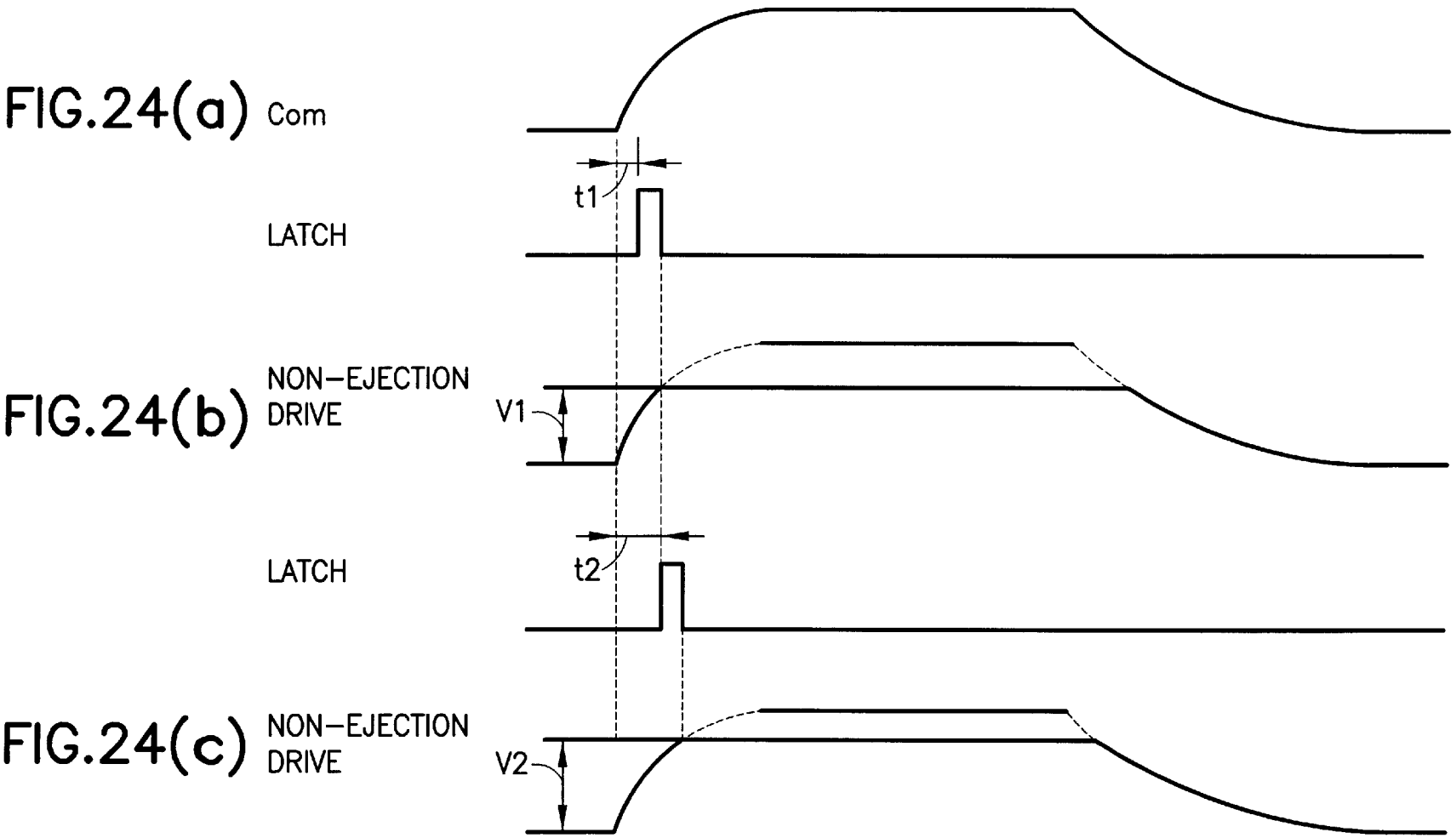
FIGS. 24(*a*) through 24(*c*) are explanatory diagrams for explaining the relationship between the drive waveform, the latch timing signal and the non-ejection driving waveform.

Since the drive waveform is a waveform that rises up with the predetermined rising up or leading edge time constant as shown in FIG. 24(*a*), the latch signal for the printing image data is applied to the latch circuit 112 at a time when a delay time t1 from the start of rising up of the drive waveform has elapsed as shown in FIG. 24(*b*), and thereby, the non-ejection driving waveform of the drive voltage V1 can be obtained. The latch signal for the printing image data is applied to the latch circuit 112 at a time when the time t2 (t2>t1) from the start of rising up of the drive waveform has elapsed as shown in FIG. 24(*b*), and thereby, the non-ejection driving waveform of the drive voltage V2 (V2>V1) can be obtained.

Figure 25:
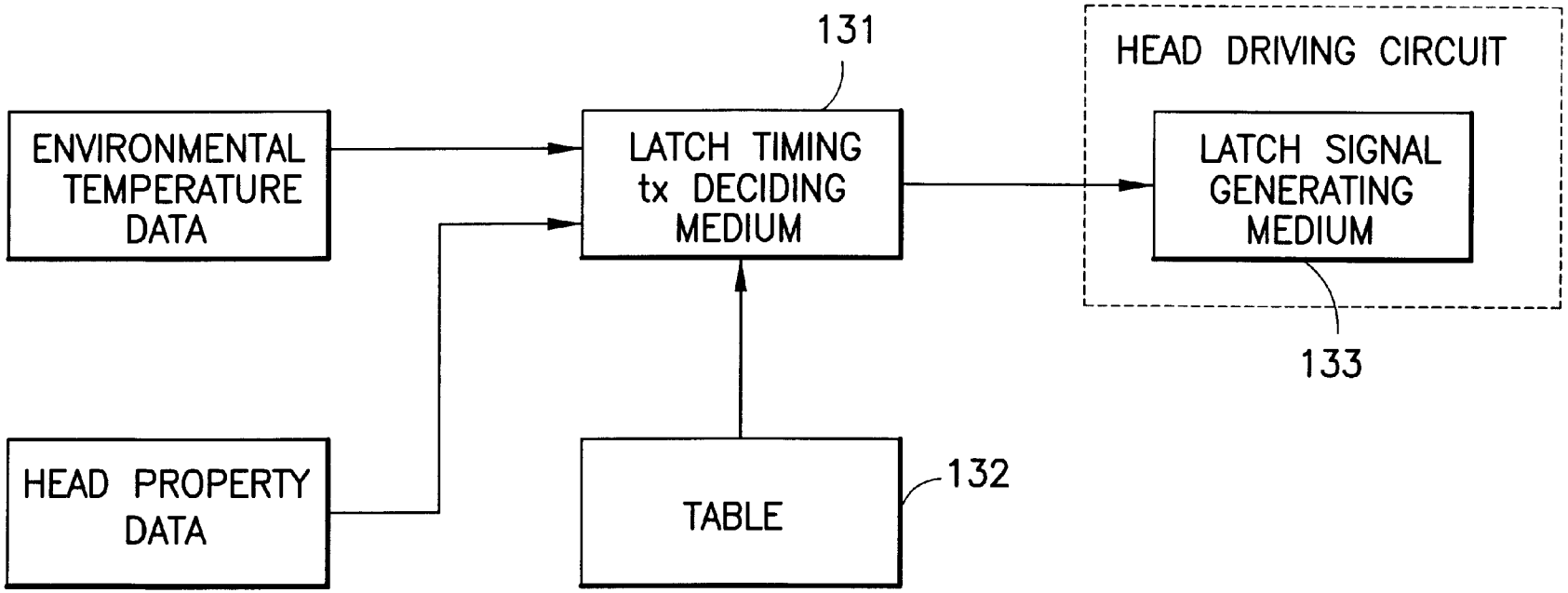
FIG. 25 is a block diagram for explaining the generation of the latch timing signal based on the environmental temperature and the property of the ink jet head.

Hereinafter, an example of determining the timing of the latch signal is described, referring to FIG. 25.

The latch timing tx determining medium 131 constructed with the CPU 80 reads out the environmental temperature data obtained in accordance with the detection information from the environmental temperature sensor 89 shown in FIG. 7 and the head property data previously stored in the ROM 83, and the latch timing tx for the environmental temperature and the head property is converted to a table format. In such a way, the latch timing tx can be determined, referring to the table 132 stored in the ROM 83. The latch timing represents the time from the rising-up timing of the drive waveform until the application of the latch signal for the printing image data.

The latch timing tx determined by the latch timing tx determining medium 131 is applied to the head driving circuit or the latch signal generating medium 133. In the latch signal generating medium 133, the latch timing tx is counted with the digital counter, and the medium 133 generates the latch signal.

Thereby, the drive waveform having the desired drive voltage V1 can be obtained. In particular, regarding the phenomenon caused by the sucking of air into the interior of the ink chamber, the higher the environmental temperature is and the lower the ink viscosity of the ink is, the more the phenomenon caused by sucking of air into the ink chamber tends to become. This phenomenon can be further reliably prevented by adjusting the voltage of the drive waveform in accordance with the environmental temperature.

Figure 26:
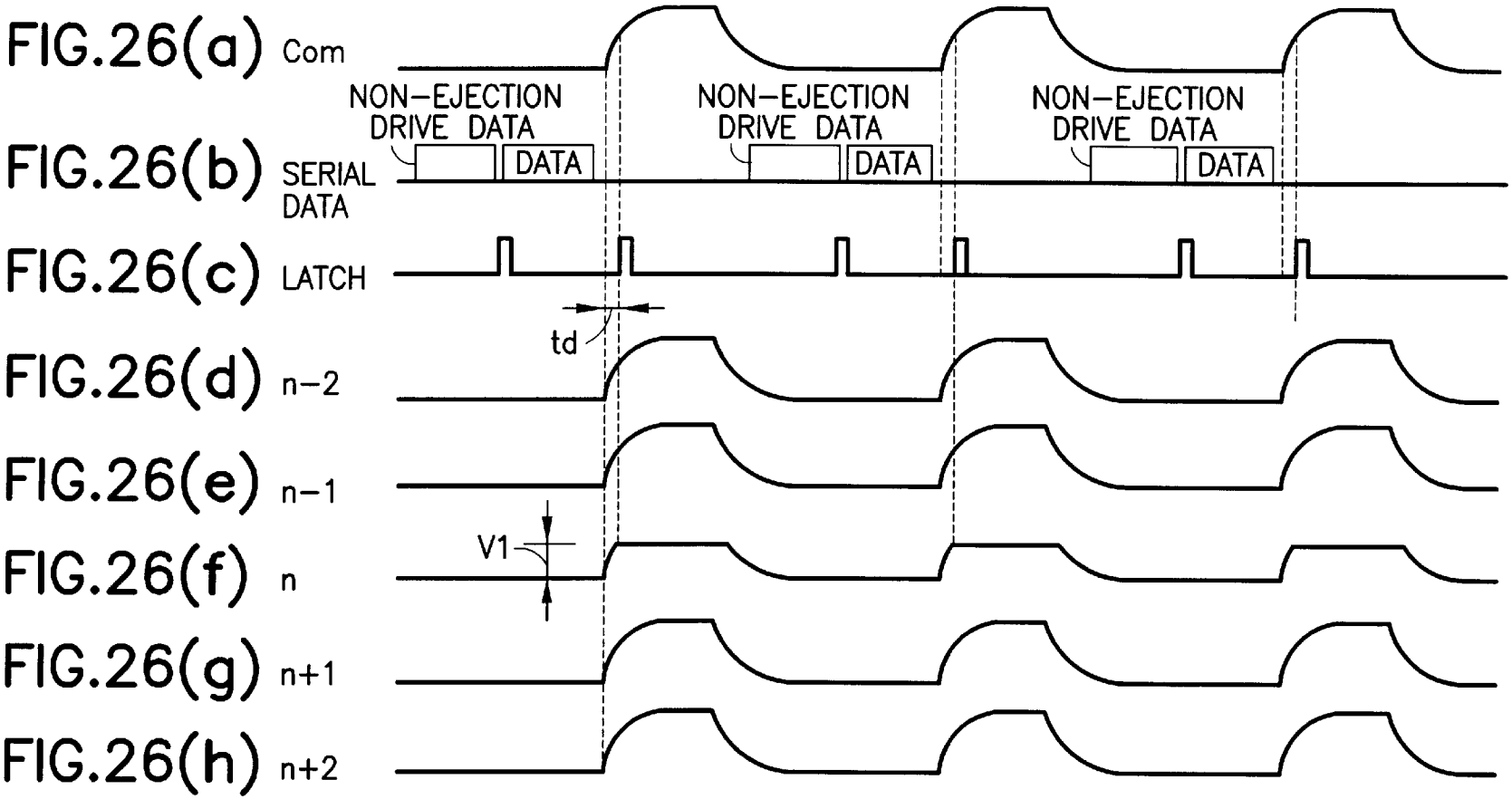
FIGS. 26(*a*) through 26(*h*) are explanatory diagrams for explaining the operation of another example of the channel selecting circuit in the case of applying the drive waveform for not ejecting the ink drop to the non-drive channel.
Figure 27:
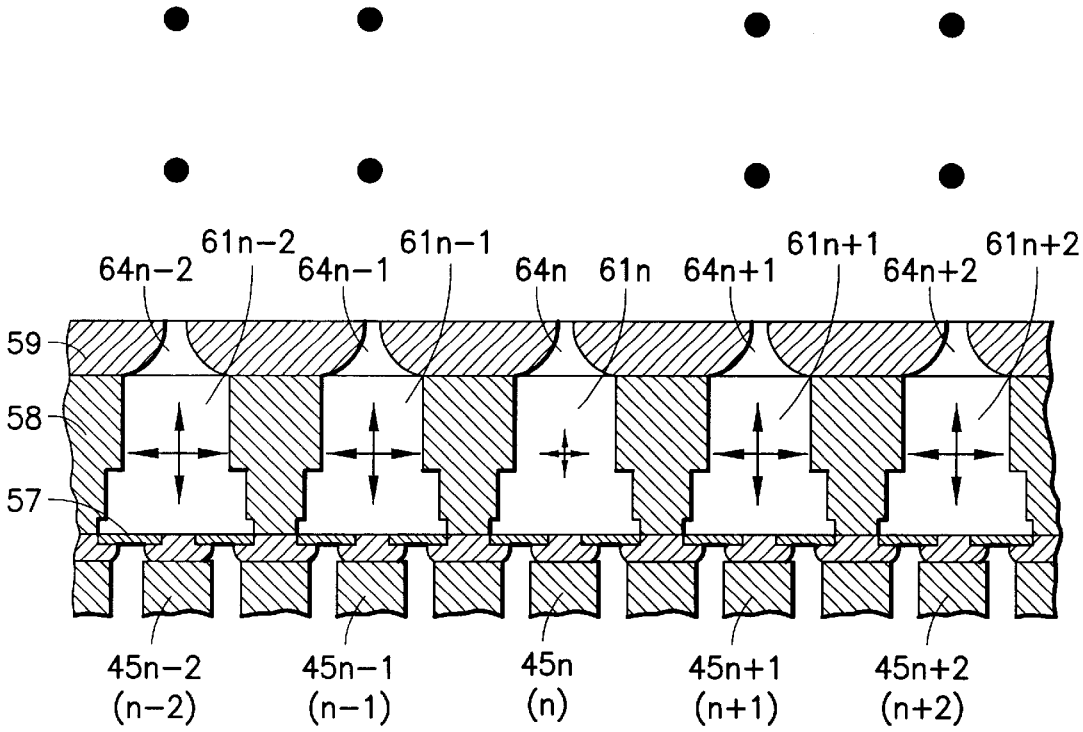
FIG. 27 is a cross-sectional view showing the main part of the ink jet head in connection with the explanation illustrated in FIGS. 26(*a*) through 26(*h*)

Next, when the respective two channels at both sides of the designated non-drive nozzle are drive nozzles, an example of applying the non-ejection driving waveform to the non-drive channel is described, referring to FIGS. 26(*a*) –26(*h*) and FIG. 27.

As shown in FIG. 26(*a*), the drive waveform P is applied to the common electrode Com of the ink jet head in accordance with the standard timing pulse STB. As shown in FIG. 26(*b*), the non-ejection driving data are transferred. The data thus transferred are latched by the latch signal shown in FIG. 26(*c*) from the shift register 111 to the latch circuit 112. The latched data are shifted to the final-stage transistor array 114. Thereafter, as shown in FIGS. 26(*d*) through 26(*h*), the drive waveform P can start to be respectively applied to the non-drive channels n and the drive channels n−2, n−1, n+1, and n+2.

Furthermore, as shown in FIGS. 26(*b*) and 26(*c*), the m-bit data corresponding to the image data are transferred to the shift register 111 with the timing pulse after the preliminary drive data are latched in the latch circuit 112, and the latch signal is generated at a time when a delay time td from the start of application of the drive waveform has elapsed. The printing data in the shift register 111 are latched in the latch circuit 112, and the data corresponding to the image data are shifted to the drive transistor Q in the transistor array 114.

For this reason, the bit of the non-drive channel n is changed to "0" by the data corresponding to the image data. In the non-drive channel n, as shown in FIG. 26(*f*), the switching transistor is put into a closed state by the non-ejection driving data and the switching transistor is put into an open state at a midpoint of raising up of the dive waveform P. Consequently, the electric potential of the drive waveform at the time is maintained at a decreased voltage level V1. Thereafter, when the drive waveform P falls down, the operation of discharging is performed by the action of the diode connected in parallel with the transistor. In such a way, a gradually decreasing waveform can be provided as a non-ejection driving waveform.

In such a way, as shown in FIG. 27, the ejection driving waveform (drive voltage Vp) is applied to the piezoelectric elements 45n−2, 45n−1, 45n+1, and 45n+2of the drive nozzles 64n−2, 64n−1, 64n+1, and 64n+2. The non-ejection driving waveform (drive voltage V1) is applied to the piezoelectric element 45n of the non-drive nozzle 64n. In a state as described above, the ink drops are respectively ejected from the drive nozzles 64n−2, 64n−1, 64n+1, and 64n+2. The ink drop is not ejected from the non-drive nozzle 64n. The volume of the ink chamber of the non-drive nozzle decreases due to the lifting-up of the vibration plate 57, and thereby, the increase of the volume due to the lifting-up of the nozzle plate 59 can be cancelled.

Consequently, in the non-drive channel, the volume of the ink chamber starts to decrease at the beginning of the non-ejection driving, and the increase of the volume thereafter is cancelled. The ink chamber of the non-drive channel returns to a substantially normal state and the volume of the chamber does not change at all. Consequently, the ink meniscus surface of the non-drive nozzle is not sucked into the ink chamber, and thereby, it is possible to prevent the mis-ejection or insufficient ejection of the ink drop when the non-drive channel later becomes a drive channel. Furthermore, by applying slight meniscus vibration to the non-drive nozzle, the occurrence of the meniscus of the non-drive nozzle irregularly changing in accordance with the driving state of the surrounding nozzles can be suppressed to a level of the vibration in a stable area, and further the variation of the ejection performance can be prevented, Thereby, a printing operation can be performed accurately and reliably.

The selection of the non-drive nozzle to be applied with the non-ejection driving waveform (non-ejection drive) is described, referring to FIG. 21, FIG. 27 and FIGS. 28(*a*) –28(*e*).

In the example of FIG. 27, assuming that the respective channels at both sides of the designated non-drive nozzle are drive nozzles, the non-ejection driving waveform is applied to the non-drive channel. The nozzles of the respective two adjacent channels at both sides of the designated non-drive nozzle are successively driven. Thereafter, the designated nozzle is driven. On this occasion, the positional displacement of the print starting dot of the non-drive nozzle is large.

In contrast, in the case of non-ejection driving for the designated nozzle, the positional displacement of the dot is improved. Thereby, accurate and reliable printing can be achieved even for the print starting dot.

In the case of printing the image data with the pattern of the drive nozzle (drive channel) and the non-drive nozzle (non-drive channel) as shown in FIG. 28(*a*) [in FIG. 28, the mark "●" represents the drive channel, the mark "○" the non-drive channel, and the mark "⊙" represents the non-ejection driving channel], FIG. 28(*b*) shows the example of driving the non-drive nozzle of both-sides two-channels non-drive nozzle adjacent to the drive nozzle with the non-ejection driving pattern (⊙⊙●⊙⊙○).

Furthermore, FIG. 28(*c*) shows the example of driving the non-drive nozzle of the adjacent one channel of the drive nozzle with the non-ejection driving pattern (○⊙●⊙○). FIG. 28(*d*) shows the example (the example of FIG. 21) of driving the non-drive nozzle surrounded with the drive nozzles at both sides with the non-ejection driving pattern (○●⊙●○). FIG. 28(*e*) shows the example of driving the non-drive nozzles of the two successive channels adjacent to the 2-channel successive drive nozzle at both sides with non-ejection driving pattern (○⊙●●⊙○).

If the printing results of the respective examples of FIGS. 28(*b*) through 28(*e*) are compared with the printing results in the case of not performing the non-ejection drive, the non-existence of dot(s) (flanking) or the unfavorable printing (faint printing, position-shifted printing, or other misprinting, etc.) can be eliminated. As a result, further preferable printing results are obtained, compared with the case of not performing the non-ejection drive.

In such a way, by selecting the non-drive nozzle to be driven with the non-ejection drive, the power consumption is suppressed, and in addition, the durability and useful life of the ink jet head is improved, compared with a method of always driving all of the non-drive nozzles with the non-ejection drive pattern.

The relationship between the environmental temperature and the non-ejection drive is described hereinafter.

When the environmental temperature increases, the viscosity of the ink is lowered and thereby, the stability of the ink ejection is deteriorated. The environmental temperature is detected by the environmental temperature sensor 89. When the temperature thus detected exceeds the predetermined acceptable environmental temperature, the non-drive nozzle is driven according to the non-ejection drive pattern. As a result, the deterioration of the ink ejection stability following the ink viscosity lowering is eliminated.

According to this example, even when the environmental temperature changes from 20° C. to 35° C., an improved property of the ink ejection stability is achieved.

In such a way, whether or not the non-ejection drive should be performed is selected based on a detected result of environmental temperature, and thereby, the ink ejection accuracy and stability is secured even in a high-temperature environment.

The ink jet printing apparatus of preferred embodiments of the present invention may be conveniently implemented using the ink jet printing head including the ink chamber, the drive element (piezoelectric element), the ink channel, and the nozzle, through which the ink drop is ejected outside of the ink jet head, according to the teachings of the present specification, as is apparent to those skilled in the art. An appropriate ink jet printing apparatus can readily be prepared by the skilled persons based on the teachings of the present disclosure, as will be apparent to those skilled in the ink jet printing technology.

The invention may also be implemented by providing an ink jet printing head in an ink jet printing apparatus or by interconnecting an appropriate ink jet printing head including the aforementioned ink jet elements with the printing apparatus or system, as will be readily apparent to those skilled in the art.

Obviously, numerous modifications to or variations of the present invention are possible in light of the above teachings. It is therefore to be understood that, within the scope of the appended claims, the invention may be practiced otherwise than as specifically described herein.

Having now fully described the invention, it will be apparent to the ordinary skilled persons in the art that many changes and modifications can be made in addition to embodiments described heretofore, without departing from the spirit and scope of the present invention as set forth herein.

This application is based on Japanese Patent Application No. JPAP09-256278, filed on Sep. 22, 1997, Japanese Patent Application No. JPAP09-260075, filed on Sep. 25, 1997, and Japanese Patent Application No. JPAP10-196913, filed on Jul. 13, 1998, the entire contents of which are herein incorporated by reference.

What is claimed is:

1. An ink jet printing apparatus including an ink jet head, wherein said ink jet head comprises:

a plurality of nozzles for ejecting ink drops;

a plurality of ink chambers, each having an internal volume, wherein each nozzle is in fluid communication with the internal volume of at least one ink chamber;

a plurality of electromechanical conversion elements, wherein each electromechanical conversion element is in functional association with an ink chamber and nozzle; and a head driving circuit, configured and adapted to simultaneously provide an ejection driving waveform and a non-ejection driving waveform to said electromechanical elements, wherein the ejection driving waveform is applied to those electromechanical conversion elements associated with nozzles from which ejection of an ink drop is required to form an image in a print operation, and the non-ejection driving waveform is applied to those electromechanical conversion elements associated with nozzles from which ejection of an ink drop from the associated nozzle is not required to form an image in the print operation, wherein the internal volume of each ink chamber is changed by driving said associated electromechanical conversion element when either an ejection driving waveform or a non-ejection driving waveform is applied to said associated electromechanical conversion element, such that, when, in accordance with image data, ejection of an ink drop from a nozzle is required to form an image in a print operation, an ejection driving waveform is applied to said electromechanical conversion element associated with the nozzle, compressing said ink chamber an amount sufficient to eject an ink drop, and when, in accordance with image data, ejection of an ink drop from a nozzle is not required to form an image in a print operation, a non-ejection driving waveform is applied to said electromechanical conversion element associated with the nozzle, compressing said ink chamber an amount less than that required to eject an ink drop, but sufficient to prevent air from entering said ink chamber through said nozzle.

2. The ink jet printing apparatus as defined in claim 1, wherein said non-ejection driving waveform has a reduced drive voltage compared to that of said ejection driving waveform.

3. The ink jet printing apparatus as defined in claim 2, wherein said ink jet printing apparatus further comprising:

a shift register for storing the data;

a latch circuit for latching the data stored in said shift register;

a switching medium for controlling the operation of applying the drive waveform to said electromechanical conversion elements by turning on and off the drive waveform in accordance with the data latched in said latch circuit; and a latch signal generating medium for latching the data stored in said shift register in said latch circuit and generating the latch signal for applying the latched signal to said switching medium.

4. The ink jet printing apparatus as defined in claim 3, wherein said ink jet printing apparatus further comprises a latch signal generating medium for transferring the image data to said shift register after generating the latch signal for latching the image-data-existing signal into said latch circuit from said shift register and applying the latched signal to said switching medium, and for generating the latch signal with a predetermined timing in order to latch the image data transferred to said shift register into said latch circuit and thereafter to shift the latched image data to said switching medium.

5. The ink jet printing apparatus as defined in claim 4, wherein said predetermined timing is determined by a value guided out from a table including parameters of nozzle property and environmental temperature.

6. The ink jet printing apparatus as defined in claim 1, wherein said non-ejection driving waveform is applied to said specified electromechanical conversion elements of the non-drive nozzles only when a drive pattern at the time of driving said electromechanical conversion elements of said ink jet head in accordance with the image data coincides with a predetermined pattern.

7. The ink jet printing apparatus as defined in claim 6, wherein said ink jet printing apparatus further comprises:

a data sending-out medium for sending out the data for driving said electromechanical conversion elements in accordance with the image data with a predetermined timing, after sending out the data for driving said specified electromechanical conversion elements of said non-drive nozzles of said ink jet head and starting to apply the drive waveform to said electromechanical conversion elements; and wherein said non-ejection driving waveform having a reduced drive voltage of said driving waveform is applied to said respective electromechanical conversion elements of said specified non-drive nozzles.

8. The ink jet printing apparatus as defined in claim 7, wherein said ink jet printing apparatus further comprises:

a shift register for storing the data;

a latch circuit for latching the data stored in said shift register;

a switching medium for controlling the operation of applying the drive waveform to said electromechanical conversion elements by turning on and off the drive waveform in accordance with the data latched in said latch circuit; and a latch signal generating medium for transferring an image-data-existing date for driving said electromechanical conversion element of a specified non-drive nozzle to said shift register when the image data coincide with the predetermined drive pattern before transferring the image data, and for generating the latch signal in order to latch the data transferred to said shift register in said latch circuit and apply the latched signal to said switching medium.

9. The ink jet printing apparatus as defined in claim 1, wherein said non-ejection driving waveform has a reduced drive voltage compared with that of said ejection driving waveform.

10. The ink jet printing apparatus as defined in claim 9, wherein said ink jet printing apparatus further comprises:

a shift register for storing the data;

a latch circuit for latching the data stored in said shift register;

a switching medium for controlling the operation of applying the drive waveform to said electromechanical conversion elements by turning on and off the drive waveform in accordance with the data latched in said latch circuit.

a latch signal generating medium for transferring an image-data-existing date for driving said electromechanical conversion element of a specified non-drive nozzle to said shift register when the image data coincide with the predetermined drive pattern before transferring the image data, and for generating the latch signal in order to latch the data transferred to said shift register in said latch circuit and apply the latched signal to said switching medium.

11. The ink jet printing apparatus as defined in claim 10, wherein said ink jet printing apparatus further comprises a latch signal generating medium for transferring the image data to said shift register after generating the latch signal for latching the image-data-existing signal into said latch circuit from said shift register and applying the latched signal to said switching medium, and for generating the latch signal with a predetermined timing in order to latch the image data transferred to said shift register into said latch circuit and thereafter to shift the latched image data to said switching medium.

12. The ink jet printing apparatus as defined in claim 11, wherein said predetermined timing is determined by a value guided out from a table including parameters of nozzle property and environmental temperature.

13. The ink jet printing apparatus according to claim 1, wherein the volume of said ink chamber of said nozzle is increased when a piezoelectric element of said drive nozzle is driven by a drive energy; and wherein said drive energy corresponds to the increase of the volume of said ink chamber.

14. An ink jet printing apparatus including an ink jet head, wherein said ink jet head comprises:

a plurality of nozzles for ejecting ink drops;

a plurality of ink chambers arranged in parallel with each other, each ink chamber having an internal volume, wherein each nozzle is in fluid communication with the internal volume of at least one ink chamber; and a plurality of energy generating elements, wherein each energy generating element is in functional association with an ink chamber and nozzle for pressurizing the ink in the associated ink chamber and for generating the energy for ejecting the ink drops from said associated nozzle;

a head driving circuit, configured and adapted to simultaneously provide an ejection driving waveform and a non-ejection driving waveform to the energy generating elements, wherein the ejection driving waveform is applied to those energy generating elements associated with nozzles from which ejection of an ink drop is required to form an image in a print operation, and the non-ejection driving waveform is applied to those energy generating elements associated with nozzles from which ejection of an ink drop from the associated nozzle is not required to form an image in the print operation, such that, when, in accordance with image data, ejection of an ink drop from a nozzle is required to form an image in a print operation, an ejection driving waveform is applied to the energy generating element associated with the nozzle, compressing said ink chamber an amount sufficient to eject an ink drop, and when, in accordance with image data, ejection of an ink drop from a nozzle is not required to form an image in a print operation, a non-ejection driving waveform is applied to the energy generating element associated with the nozzle, compressing said ink chamber an amount less than that required to eject an ink drop, but sufficient to prevent air from entering said ink chamber through said nozzle.

15. The ink jet printing apparatus as defined in claim 14, wherein said ink jet printing apparatus further comprises a temperature detecting medium for detecting the environmental temperature, and wherein whether said non-ejection driving waveform is applied or not applied to said energy generating element is selected in accordance with the detected environmental temperature.

16. The ink jet printing apparatus as defined in claim 15, wherein, when the nozzle adjacent to the noted non-drive nozzle is the drive nozzle for ejecting the ink drops, said non-ejection driving waveform is applied to said energy generating element of said noted non-drive nozzle.

17. The ink jet printing apparatus as defined in claim 16, wherein, when the plural nozzles adjacent to the noted non-drive nozzle are the drive nozzles for ejecting the ink drops, said non-ejection driving waveform is applied to said energy generating elements of said noted non-drive nozzles.

18. The ink jet printing apparatus as defined in claim 14, wherein, when the nozzle adjacent to the noted non-drive nozzle is the drive nozzle for ejecting the ink drops, said non-ejection driving waveform is applied to said energy generating element of said noted non-drive nozzle.

19. The ink jet printing apparatus as defined in claim 14, wherein, when the nozzle adjacent to the noted non-drive nozzle is the drive nozzle for ejecting the ink drops, said non-ejection driving waveform is applied to said energy generating element of said noted non-drive nozzle.

20. The ink jet printing apparatus as defined in claim 14, wherein, when the plural nozzles adjacent to the noted non-drive nozzle are the drive nozzles for ejecting the ink drops, said non-ejection driving waveform is applied to said energy generating elements of said noted non-drive nozzles.

21. An ink jet printing apparatus including an ink jet head, wherein said ink jet head comprises:

a plurality of nozzle means for ejecting ink drops;

a plurality of ink chamber means, each having an internal volume, wherein each nozzle means is in fluid communication with the internal volume of at least one ink chamber means;

a plurality of electromechanical conversion element means, wherein each electromechanical conversion element means is in functional association with an ink chamber means and nozzle means;

a head driving circuit means, configured and adapted to simultaneously provide an ejection driving waveform and a non-ejection driving waveform to said electromechanical element means, wherein the ejection driving waveform is applied to those electromechanical conversion element means associated with nozzle means from which ejection of an ink drop is required to form an image in a print operation, and the non-ejection driving waveform is applied to those electromechanical conversion element means associated with nozzle means from which ejection of an ink drop from the associated nozzle means is not required to form an image in the print operation, wherein the internal volume of each ink chamber means is changed by driving said associated electromechanical conversion means when either an ejection driving waveform or a non-ejection driving waveform is applied to said associated electromechanical conversion element means, such that, when, in accordance with image data, ejection of an ink drop from a nozzle means is required to form an image in a print operation, an ejection driving waveform is applied to said electromechanical conversion element means associated with said nozzle means, compressing said ink chamber means an amount sufficient to eject an ink drop, and when, in accordance with image data, ejection of an ink drop from a nozzle means is not required to form an image in a print operation, a non-ejection driving waveform is applied to said electromechanical conversion element means associated with said nozzle means, compressing said ink chamber means an amount less than that required to eject an ink drop, but sufficient to prevent air from entering said ink chamber means through said nozzle means.

22. The ink jet printing apparatus as defined in claim 3, wherein said non-ejection driving waveform is applied to said specified electromechanical conversion means of the non-drive nozzle means only when the drive pattern at the time of driving said electromechanical conversion means of said ink jet head in accordance with the image data coincides with a predetermined pattern.

23. The ink jet printing apparatus as defined in claim 22, wherein said ink jet printing apparatus further comprises:

data sending-out means for sending out the data for driving said electromechanical conversion means in accordance with the image data with a predetermined timing, after sending out the data for driving said specified electromechanical conversion means of said non-drive nozzle means of said ink jet head and starting to apply the drive waveform thereto; and wherein said non-ejection driving waveform restricting the drive voltage of said driving waveform to be applied is applied to said respective electromechanical conversion means of said specified non-drive nozzle means.

24. The ink jet printing apparatus as defined in claim 23, wherein said ink jet printing apparatus further comprises:

shift register means for storing the data;

latch circuit means for latching the data stored in said shift register means;

switching means for controlling the operation of applying the drive waveform to said electromechanical conversion means by turning on and off the drive waveform in accordance with the data latched in said latch circuit means; and latch signal generating means for transferring a signal of image data-existing for driving said specified electromechanical conversion means of said non-drive nozzle means to said shift register means and for generating the latch signal for latching the data thus transferred to said shift register means in said latch circuit means and applying the latched data are applied to said switching means.

25. The ink jet printing apparatus as defined in claim 21, wherein said ink jet printing apparatus further comprises data sending-out means for sending out the data for driving said electromechanical conversion means in accordance with the image data with a predetermined timing, after sending out the data for driving said specified electromechanical conversion means of said non-drive nozzle means of said ink jet head and starting to apply the drive waveform thereto; and wherein said non-ejection driving waveform restricting the drive voltage of said driving waveform to be applied is applied to said respective electromechanical conversion means of said specified non-drive nozzle means.

26. The ink jet printing apparatus as defined in claim 25, wherein said ink jet printing apparatus further comprises:

shift register means for storing the data;

latch circuit means for latching the data stored in said shift register means;

switching means for controlling the operation of applying the drive waveform to said electromechanical conversion means by turning on and off the drive waveform in accordance with the data latched in said latch circuit means; and latch signal generating means for transferring a signal of image data-existing for driving said specified electromechanical conversion means of said non-drive nozzle means to said shift register means and for generating the latch signal for latching the data thus transferred to said shift register means in said latch circuit means and applying the latched data are applied to said switching means.

27. The ink jet printing apparatus as defined in claim 26, wherein said ink jet printing apparatus further comprises a latch signal generating means for transferring the image data to said shift register means after latching said image data-existing signal from said shift register means to said latch circuit means, for latching the image data in the shift register means in said latch circuit means and shifting the latched image data are shifted to said switching means.

28. The ink jet printing apparatus as defined in claim 27, wherein said predetermined timing is determined by a value guided out from a table including parameters of nozzle property and environmental temperature.

29. An ink jet printing apparatus including an ink jet head, wherein said ink jet head comprises:

a plurality of nozzle means for ejecting ink drops;

a plurality of ink chamber means arranged in parallel with each other, each ink chamber means having an internal volume, wherein each nozzle means is in fluid communication with the internal volume of at least one ink chamber means;

a plurality of energy generating means, wherein each energy generating means is in functional association with an ink chamber means and nozzle means for pressurizing the ink in the associated ink chamber means and for generating the energy for ejecting the ink drops from said associated nozzle means;

a head driving circuit means, configured and adapted to simultaneously provide an ejection driving waveform and a non-ejection driving waveform to the energy generating element means, wherein the ejection driving waveform is applied to those energy generating element means associated with nozzle means from which ejection of an ink drop is required to form an image in a print operation, and the non-ejection driving waveform is applied to those energy generating element means associated with nozzle means from which ejection of an ink drop from the associated nozzle means is not required to form an image in the print operation, such that, when, in accordance with image data, ejection of an ink drop from a nozzle means is required to form an image in a print operation, an ejection driving waveform is applied to the energy generating means associated with the nozzle, compressing said ink chamber means an amount sufficient to eject an ink drop, and when, in accordance with image data, ejection of an ink drop from a nozzle is not required to form an image in a print operation, a non-ejection driving waveform is applied to the energy generating means associated with the nozzle means, compressing said ink chamber means an amount less than that required to eject an ink drop, but sufficient to prevent air from entering said ink chamber means through said nozzle means.

30. The ink jet printing apparatus as defined in 29, wherein said ink jet printing apparatus further comprises temperature detecting means for detecting the environmental temperature, and wherein said non-ejection driving waveform selects whether said non-ejection driving waveform is applied or not applied to said energy generating means in accordance with the detected environmental temperature.

31. The ink jet printing apparatus as defined in claim 30, wherein, when the nozzle means adjacent to the noted non-drive nozzle means is the drive nozzle means for ejecting the ink drops, said non-ejection driving waveform is applied to said energy generating means of said noted non-drive nozzle means.

32. The ink jet printing apparatus as defined in claim 29, wherein, when the nozzle means adjacent to the noted non-drive nozzle is the drive nozzle means for ejecting the ink drops, said non-ejection driving waveform is applied to said energy generating means of said noted non-drive nozzle means.

33. The ink jet printing apparatus as defined in claim 29, wherein, when the plural nozzle means adjacent to the noted non-drive nozzle means is the drive nozzle means for ejecting the ink drops, said non-ejection driving waveform is applied to said energy generating means of said noted non-drive nozzle means.

34. A method of ink jet printing by use of an ink jet head, comprising the steps of:

preparing an ink jet head comprising a plurality of nozzles for ejecting ink drops; a plurality of ink chambers, each having an internal volume, wherein each nozzle is in fluid communication with the internal volume of at least one ink chamber; and a plurality of electromechanical conversion elements, wherein each electromechanical conversion element is in functional association with an ink chamber and nozzle, and is configured and adapted to be driven by an ejection driving waveform when ejection of an ink drop from the associated nozzle is required to form an image in a print operation, and to be driven by a non-ejection driving waveform when ejection of an ink drop from the associated nozzle is not required to form an image in a print operation;

changing the internal volume of each ink chamber by driving said associated electromechanical conversion element; and simultaneously applying either an ejection driving waveform or a non-ejection driving waveform to each electromechanical conversion element, such that, when, in accordance with image data, ejection of an ink drop from a nozzle is required to form an image in a print operation, an ejection driving waveform is applied to said electromechanical conversion element associated with the nozzle, compressing said ink chamber an amount sufficient to eject an ink drop, and when, in accordance with image data, ejection of an ink drop from a nozzle is not required to form an image in a print operation, a non-ejection driving waveform is applied to said electromechanical conversion element associated with the nozzle, compressing said ink chamber an amount less than that required to eject an ink drop, but sufficient to prevent air from entering said ink chamber through said nozzle.

35. The method of ink jet printing as defined in claim 34, further comprising the steps of:

preparing a data sending-out medium for sending out the data for driving said electromechanical conversion elements with a drive waveform that is one of the ejection drive waveform or the non-ejection drive waveform in accordance with the image data with a predetermined timing, after sending out the data for driving all of said electromechanical conversion elements of said ink jet head and starting to apply the drive waveform thereto; and applying said non-ejection driving waveform restricting the drive voltage of said driving waveform to said electromechanical conversion elements associated with the nozzles from which ejection of an ink drop is not required.

36. The method of ink jet printing as defined in claim 35, comprising the step of:

including a shift register for storing the data; a latch circuit for latching the data stored in said shift register; a switching medium for controlling the operation of applying the drive waveform to said electromechanical conversion elements by turning on and off the drive waveform in accordance with the data latched in said latch circuit; and a latch signal generating medium for latching the data stored in said shift register in said latch circuit and generating the latch signal for applying the latched signal to said switching medium.

37. The method of ink jet printing as defined in claim 36, comprising the step of:

preparing said ink jet printing apparatus further including a latch signal generating medium for transferring the image data to said shift register after latching said image data-existing signal from said shift register to said latch circuit, for latching the image data in the shift register in said latch circuit and shifting the latched image data are shifted to said switching medium.

38. The method of ink jet printing as defined in claim 37, comprising the step of:

determining said predetermined timing by a value guided out from a table including parameters of nozzle property and environmental temperature.

39. The method of ink jet printing as defined in claim 34, further comprising the step of:

applying said non-ejection driving waveform to said specified electromechanical conversion elements of the non-drive nozzles only when a drive pattern at the time of driving said electromechanical conversion elements of said ink jet head in accordance with the image data coincides with a predetermined pattern.

40. The method of ink jet printing as defined in claim 39, further comprising the steps of:

including a data sending-out medium for sending out the data for driving said electromechanical conversion elements in accordance with the image data with a predetermined timing, after sending out the data for driving said electromechanical conversion elements associated with nozzles of said ink jet head from which an ink drop is not required, and starting to apply a drive waveform having a drive voltage thereto; and applying said non-ejection driving waveform restricting the drive voltage of said driving waveform to be applied to said respective electromechanical conversion elements of said specified non-drive nozzles.

41. The method of ink jet printing as defined in claim 40, comprising the step of:

preparing said ink jet printing apparatus further including a shift register for storing the data; a latch circuit for latching the data stored in said shift register; a switching medium for controlling the operation of applying the drive waveform to said electromechanical conversion elements by turning on and off the drive waveform in accordance with the data latched in said latch circuit; and a latch signal generating medium for transferring a signal of image data-existing for driving said specified electromechanical conversion elements of said non-drive nozzles to said shift register and for generating the latch signal for latching the data thus transferred to said shift register in said latch circuit and applying the latched data are applied to said switch medium.

42. The method of ink jet printing as defined in claim 34, further comprising the steps of:

including a data sending-out medium for sending out the data for driving said electromechanical conversion elements in accordance with the image data with a predetermined timing, after sending out the data for driving said electromechanical conversion elements associated with nozzles of said ink jet head from which an ink drop is not required, and starting to apply a drive waveform having a drive voltage thereto; and applying said non-ejection driving waveform restricting the drive voltage of said driving waveform to be applied to said respective electromechanical conversion elements of said specified non-drive nozzles.

43. The method of ink jet printing as defined in claim 42, comprising the step of:

including a shift register for storing the data; a latch circuit for latching the data stored in said shift register; a switching medium for controlling the operation of applying the drive waveform to said electromechanical conversion elements by turning on and off the drive waveform in accordance with the data latched in said latch circuit; and a latch signal generating medium for transferring a signal of image data-existing for driving said specified electromechanical conversion elements of said non-drive nozzles to said shift register and for generating the latch signal for latching the data thus transferred to said shift register in said latch circuit and applying the latched data are applied to said switching medium.

44. The method of ink jet printing as defined in claim 43, comprising the step of:

preparing said ink jet printing apparatus further including a latch signal generating medium for transferring the image data to said shift register after latching said image data-existing signal from said shift register to said latch circuit, for latching the image data in the shift register in said latch circuit and shifting the latched image data are shifted to said switching medium.

45. The method of ink jet printing as defined in claim 44, further comprising the step of:

determining said predetermined timing by a value guided out from a table including parameters of nozzle property and environmental temperature.

46. A method of ink jet printing by used of an ink jet head, comprising the steps of:

preparing an ink jet head comprising a plurality of nozzles for ejecting ink drops;

a plurality of ink chambers arranged in parallel with each other, each having an internal volume, wherein each nozzle is in fluid communication with the internal volume of at least one ink chamber; and a plurality of energy generating elements, each energy generating element is in functionally associated with an ink chamber and nozzle for pressurizing the ink in the respective ink chambers and for generating the energy for ejecting the ink drops from said associated nozzles, and simultaneously applying either an ejection driving waveform or a non-ejection driving waveform is applied to said associated energy generating element, such that, when, in accordance with image data, ejection of an ink drop from a nozzle is required to form an image in a print operation, an ejection driving waveform is applied to the energy generating element associated with the nozzle, compressing said ink chamber an amount sufficient to eject an ink drop, and when, in accordance with image data, ejection of an ink drop from a nozzle is not required to form an image in a print operation, a non-ejection driving waveform is applied to said energy generating element associated with the nozzle, compressing said ink chamber an amount less than that required to eject an ink drop, but sufficient to prevent air from entering said ink chamber through said nozzle.

47. The method of ink jet printing as defined in claim 46, further comprising the steps of:

including a temperature detecting medium for detecting the environmental temperature, and selecting whether said non-ejection driving waveform is applied or not applied to said energy generating elements in accordance with the detected environmental temperature, by use of said non-ejection driving waveform.

48. The method of ink jet printing as defined in claim 47, further comprising the step of;

applying said non-ejection driving waveform to said energy generating element associated with nozzles from which an ink drop is not required, when one or more nozzles adjacent to the nozzle from which an ink drop is not required is are nozzles for ejecting ink drops.

49. The method of ink jet printing as defined in claim 47, further comprising the step of:

applying said non-ejection driving waveform to said energy generating element associated with nozzles from which an ink drop is not required, when one or more nozzles adjacent to the nozzle from which an ink drop is not required is are nozzles for ejecting ink drops.

50. The method of ink jet printing as defined in claim 46, further comprising the step of:

applying said non-ejection driving waveform to said energy generating elements associated with nozzles from which an ink drop is not required, when one or more nozzles adjacent to the nozzle from which an ink drop is not required is are nozzles for ejecting ink drops.

51. The method of ink jet printing as defined in claim 46, further comprising the step of:

applying said non-ejection driving waveform to said energy generating element associated with nozzles from which an ink drop is not required, when one or more nozzles adjacent to the nozzle from which an ink drop is not required is are nozzles for ejecting ink drops.

* * * * *